US005743202A

United States Patent [19]

Price et al.

[11] Patent Number: 5,743,202

[45] **Date of Patent: *Apr. 28, 1998**

[54] ELASTIC WAISTBAND ATTACHMENT SYSTEM

[75] Inventors: Elvin C. Price, Dacula; Preston B. Dasher, Buford; Michael Pate, Duluth, all of Ga.

[73] Assignee: Atlanta Attachment Company, Lawrenceville, Ga.

[ * ] Notice: The term of this patent shall not extend beyond the expiration date of Pat. No. 5,562,060.

[21] Appl. No.: 556,707

[22] Filed: Nov. 13, 1995

Related U.S. Application Data

[60] Provisional application No. 60/003,411 Sep. 8, 1995.

[63] Continuation-in-part of Ser. No. 503,518, Jul. 18, 1995, Pat. No. 5,562,060, which is a continuation-in-part of Ser. No. 311,921, Sep. 26, 1994, Pat. No. 5,522,332, which is a continuation-in-part of Ser. No. 131,131, Oct. 4, 1993, Pat. No. 5,437,238.

[51] Int. Cl.[6] ..... D05B 35/00; D05B 27/00

[52] U.S. Cl. ..... 112/470.31; 112/305; 112/306; 112/147; 112/153; 112/470.29; 112/475.03; 112/475.06; 112/475.13

[58] Field of Search ..... 112/475.01, 475.02, 112/475.03, 475.04, 475.06, 475.09, 475.13, 470.29, 470.31, 470.02, 305, 306, 322, 147, 153

[56] References Cited

U.S. PATENT DOCUMENTS

| | | | |
|---|---|---|---|
| 4,046,087 | 9/1977 | Manetti | 112/121 |
| 4,053,967 | 10/1977 | Mair | 26/98 |
| 4,185,570 | 1/1980 | Kleinschmidt et al. | 112/470.29 |
| 4,265,187 | 5/1981 | Torre | 112/121.26 |
| 4,473,017 | 9/1984 | Letard et al. | 112/141 |
| 4,484,532 | 11/1984 | Norz | 112/2 |
| 4,681,051 | 7/1987 | Kirch et al. | 112/306 |
| 4,883,005 | 11/1989 | Wehmeyer | 112/470.29 X |
| 4,928,610 | 5/1990 | Akutsu | 112/153 |
| 5,131,336 | 7/1992 | Kono et al. | 112/470.29 |
| 5,188,047 | 2/1993 | Rohr et al. . | |
| 5,251,557 | 10/1993 | Rohr | 112/306 |
| 5,269,239 | 12/1993 | Adamski, Jr. et al. | 112/121 |
| 5,269,257 | 12/1993 | Yamazaki . | |
| 5,370,072 | 12/1994 | Adamski, Jr. | 112/306 X |
| 5,417,174 | 5/1995 | Allison et al. | 112/470.02 X |
| 5,437,238 | 8/1995 | Price et al. . | |
| 5,522,332 | 6/1996 | Price et al. | 112/470.29 |
| 5,562,060 | 10/1996 | Price et al. | 112/470.29 |
| 5,570,647 | 11/1996 | Adamski, Jr. et al. | 112/470.31 |

FOREIGN PATENT DOCUMENTS

| | | |
|---|---|---|
| 58-11471 | 1/1983 | Japan . |

*Primary Examiner*—Paul C. Lewis
*Attorney, Agent, or Firm*—Isaf, Vaughan & Kerr

[57] ABSTRACT

A looped elastic waistband (14) is positioned along a circular sewing path (12) with the waist edge (21) of a pair of pants (12) in straddling relationship thereover. The garment parts are advanced past a folding assembly (61), which folds the waist edge (21) of the pants (16) over the waistband (14), and past sewing needles (13) that form lines of stitching along the aligned edges of the pants (16) and waistband (14) and through the folded portion (22) of the pants waist (19). In the meantime, the position of the waist edge (21) of the pants (16) over the waistband (14) is adjusted in response to position the waist edges (21) as detected by body edge sensor (13) which controls the reciprocation of a pair of drive wheels (87 and 88) of an edge guide assembly (86) which engage and urge the waist edge (21) of the pants (16) across from the sewing path (12). An expansion roller assembly (62) maintains tension in the waistband (14) and the waist edge (20) of the pants (16) during a sewing operation, and is pivotable to equalize tension in the waistband (14) and pants (16).

33 Claims, 9 Drawing Sheets

1)Band detected by band sensor 58, Roller frame 71 moves to first operative position.

2)Pants detected by body sensor 113, Roller frame is moved to second operative position, idler wheel 96 engages and puller 41 moves down onto pants.

3)Pants and elastic band are prefed br the puller 41. The pants are moved inwardly of the sewing path 12 by edge guide assembly as under control of prefed sensor 112.

4)First portion of crotch seam of pants is detected by sensor 50. Prefeeding is stopped with seam positioned upstream of sewing needles 13.

5)Waist edge 21 of pants 16 is folded under and across waistband 14.

6)Presser foot 36 lowers and sewing needles 13 engage garment and stitches 8 and 9 are formed.

7)Body guide sensor 113 detects position of pants waist edge 21 and controls edge guide assembly 86 to position waist edge 21 within sewing path.

8)Stitches counted between detection of first portion of the crotch seam of the pants and a second portion thereof.

9)As tension across portions of the garment increases and decreases, roller frame 71 pivots and raises and lowers to equalize tension across garment.

10)Recorded stitch count detected signaling the approach of the end of edge guiding and lowering the edge wheel.

11)Body edge sensor 111 detects the folded edge of the pants.

12)Idler wheel 96, folder tongue 67 and guide wheel are retracted. Lift roller 141 lifts garment to support the pants as guide support 84 retracts and edge wheel assembly 150 engages pants.

13)The crotch seam of the pants is detected. This stops the sewing cycle after a specified time.

14)The sewing cycle is completed and the pants are removed.

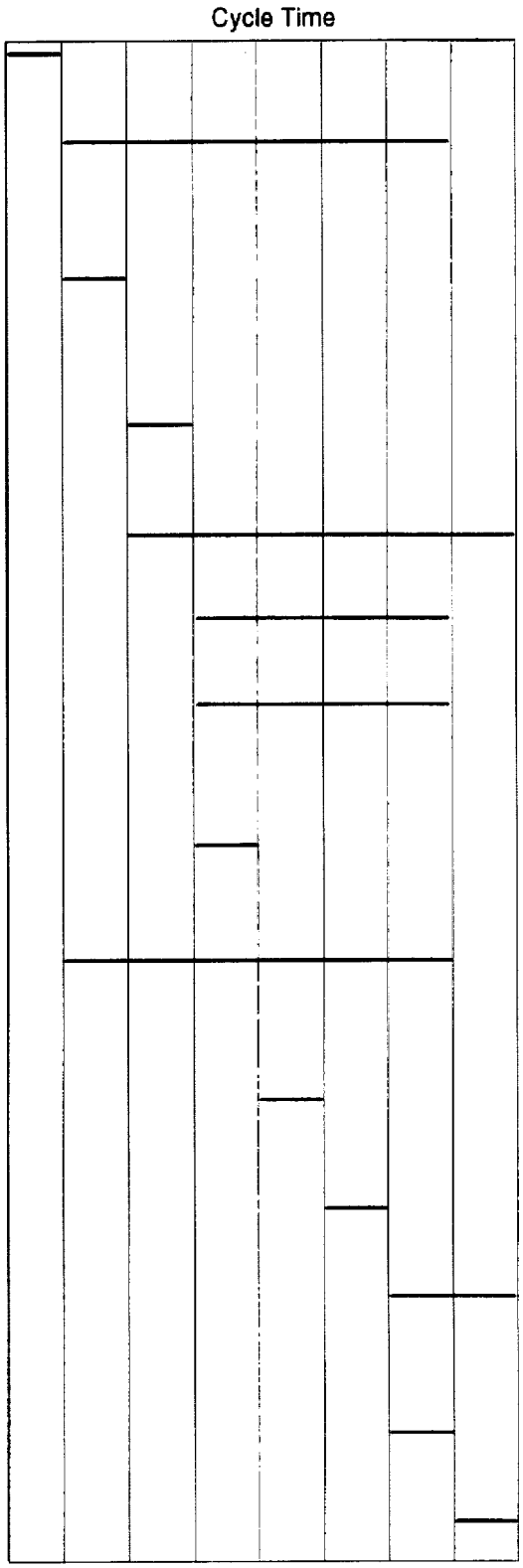

FIG. 11

ELASTIC WAISTBAND ATTACHMENT SYSTEM

CROSS REFERENCE TO RELATED APPLICATION

This is a continuation-in-part of U.S. Provisional Patent Application Ser. No. 60/003,411, filed Sep. 8, 1995, and a continuation-in-part of U.S. patent application Ser. No. 08/503,518, filed Jul. 18, 1995 now U.S. Pat. No. 5,562,060, which is a continuation-in-part of U.S. patent application Ser. No. 08/311,921, filed Sep. 26, 1994 now U.S. Pat. No. 5,522,332, which is a continuation-in-part of U.S. patent application Ser. No. 08/131,131 filed Oct. 4, 1993 now U.S. Pat. No. 5,437,238.

FIELD OF THE INVENTION

This invention relates to a method and apparatus for attaching a continuous loop elastic waistband to the continuous waist edge of a garment such as a pair of sweat pants. The waistband material is attached internally in the folded over waist of the garment by overlaying the waistband with the unfolded waist edge of the garment, stretching both the waistband and the waist edge of the garment to substantially the same breadth, advancing the waist edge and waistband through a sewing machine, progressively folding the waist edge of the garment about the waistband as they approach the sewing machine, and sewing through the folds at the sewing machine.

BACKGROUND OF THE INVENTION

In the production of garments in an industrial setting in which batches of garment parts are delivered to work stations where the garment parts are connected together, it is important that the sewing equipment provided to the worker be fast and efficient in its operation, but also it is important that the garment parts can be expediently and accurately loaded on the equipment. Further, it is highly desirable that once the garment parts have been loaded in position and the equipment is placed in operation that the worker be able to momentarily leave the equipment while the equipment continues to operate. This enables a single worker to operate more than one machine and to gather more garment parts and match them together for presentation to another, duplicate machine for its next cycle of operation.

In the production of stretchable garments, such as sweat pants having a body made of fleece or other material and a waistband of elastic or stretchable knit material, it is sometimes difficult for the worker or the sewing equipment to accurately control the material as it is being fed to the sewing machine.

For example, when the elastic waistband of a pair of sweat suit pants is to be connected to the waist edge of the pants body, the waist edge of the pants body generally is folded over the waistband, forming a tunnel or elongated pocket within which the elastic waistband is contained and attached to the waist edge of the pants. In making this fold, it is important for the amount of material of the waist edge of the pants which is folded over to be carefully matched to the size of the waistband so that the waistband is completely covered, but without creating an abundance of excess material that must be trimmed away.

Further, when the waistband and the waist edge of the pants are guided to the sewing machine, the waistband usually must be stretched more than the waist edge of the pants in order that they are properly matched in breadth as the waist edge is folded and sewn. However, the crotch seam between the legs of the pants tends to limit the amount of stretch of the pants in the direction of the seam. Thus, the pants will be subjected to variations in tension as the pants are moved along their sewing path and stretched. Such variations in tension can cause pleating and misfeeding of the garment, and necessitates adjustments in the places where excess tension is applied to the pants during operation of the system to relieve excess tension along the crotch seam.

Because of these inherent problems in folding and sewing the waist edge of a pair of pants about a stretchable waistband, machine operators have been required to develop relatively high skill in presenting and moving the work product through the sewing machine. Further, the presentation of the work product to and the sewing of the work product by the sewing machine requires substantially full attention of the operator during the cycle of operation of the sewing machine to watch for jamming, uncovered elastic, excess trimming, and the formation of wrinkles about the waistband and waist edge of the garment. This results in the operator not having enough time during the cycle of operation of the sewing machine to retrieve and assemble the next garment parts that are to be presented to the sewing machine or to operate two machines simultaneously. As a result, work productivity is slowed and there is a likelihood that the work product will not be properly formed.

Accordingly, it can be seen that a need exists for a sewing machine assembly for automatically attaching stretchable waistband materials inside the folded waist edges of garments that is easy to load and operate without requiring the complete attention of the operator so as to enable the operator to perform additional tasks and/or operate more than one machine at the same time.

SUMMARY OF THE INVENTION

Briefly described, the present invention comprises a method and apparatus for sewing a loop of elastic waistband within a folded waist portion of a garment such as a shirt body or pair of pants. During a sewing operation, the waistband and the waist portion of the garment are stretched to the same breadth so that their edges are substantially matched. The garment waist edge and waistband are advanced along a sewing path of a sewing machine during which the waist edge of the garment is folded over the waistband and sewn to enclose and attach the waistband to the garment waist edge. Prior to sewing, the garment parts are moved through a prefeeding cycle, moving about one-half way around the sewing path. During this prefeeding cycle, the garment is moved along the sewing path until the crotch seam of the garment is detected and positioned for the start of a sewing cycle. During the prefeeding cycle and the sewing cycle, the waist edge of the garment is progressively folded over and encloses the waistband and during the sewing cycle the waistband is sewn into the waist edge of the garment.

At the start of the operation of the waistband attachment system, the elastic waistband is loaded into the system, positioned within the sewing path which extends beneath the sewing needles of the sewing machine. The sewing machine generally includes a sewing head having a presser foot and a series of sewing needles aligned with the sewing path. Typically, the sewing machine includes a series of five sewing needles mounted to a reciprocating needle bar in a slightly staggered arrangement. Three of the needles form lines of 401 chain stitches in the waistband and garment to secure the waistband to the waist portion of the garment. The two left-most needles form a 406 bottom cover stitch within the garment and about the cut waist edge of the garment which has been folded over the waistband.

A garment puller is mounted to the sewing machine downstream from the sewing needles and serves as a drive means for pulling the garment about the sewing path. The garment puller includes a puller wheel rotatably mounted to the sewing machine behind the sewing needles and positioned above the sewing path. An idler wheel is mounted directly below the puller wheel such that the garment parts are engaged between the puller and idler wheel and are pulled about the sewing path during the sewing operation.

The puller wheel is connected to the drive means of the sewing machine so as to be driven by the operation of the sewing machine during the sewing operation. A separate drive means including a motor, axle, universal joint and a clutch bearing connecting the axle to the drive motor, are connected to the puller wheel for driving the puller wheel independently of the sewing machine operation during the initial, prefeeding cycle.

A guide support assembly is positioned along the sewing path, upstream from the sewing machine for guiding the elastic band in the sewing path. The guide support assembly includes a support base and a retractable finger portion formed from materials such as nylon, to enable the pants and waistband to slide thereover without dragging or being caught. The support base generally is formed with a rounded shape having a smooth surface which is lightly engaged by the pants material as the pants move toward the sewing needles. The retractable finger portion telescopes into and out of the support base and is extensible across the sewing path. The retractable finger portion supports the waistband as the waistband is pulled along the sewing path during the prefeeding cycle and most of the sewing cycle. Toward the end of the sewing cycle when the edge of the garment which was folded and sewn during the first part of the sewing cycle approaches the sewing needles, the finger portion is automatically retracted to avoid contact with the previously sewn waist edge of the garment.

A band sensor is positioned adjacent and below the guide support assembly and is directed upwardly toward the sewing path. The band sensor detects the presence of the elastic waistband being loaded into the sewing path. In response to this detection, an expansion roller assembly is activated to stretch the elastic waistband initially to a preliminary breadth to remove any slack from the waistband and to make it easier to load the pants.

The folder assembly generally comprises a curved, stationary folder plate mounted along the right side of the sewing path, with a lower edge thereof extending below the sewing path, and a retractable folder tongue mounted to a cylinder assembly and movable laterally across the sewing path toward and away from the concave surface of the curved stationary folder plate.

The expansion roller assembly generally includes a roller support frame pivotally supported intermediate its ends with elongated generally cylindrical expansion rollers rotatably supported on its ends and extending parallel to each other beneath and across the return path of the work product. The roller frame is pivotally mounted to a means for moving the roller frame vertically, which generally comprises a pneumatic cylinder, but also can include an electric motor and a lead screw or similar moving means.

The loop of elastic band material is stretched downwardly from the sewing path about the expansion rollers and upon detection of the band by the band sensor, the roller frame is moved downwardly by its cylinder to a first position to initially stretch the waistband. The pivotal mounting of the roller frame also enables the roller frame to tilt or pivot as the crotch seam of the garment is revolved around the sewing path to maintain substantially equal tension on the elastic waistband and the garment as the garment parts are sewn. A tension roller is mounted to the roller support arm, and is adapted to be engaged and urged upwardly or downwardly by the garment as the tension in the garment waist edge changes. Movement of the tension roller operates a switch which causes the roller frame to be raised or lowered as necessary to adjust the tension on the waistband and garment.

Once the waistband has been loaded on the elastic waistband attachment system, the waist edge of the garment, i.e., a pair of pants, is loaded onto the system in a telescopic overlying relationship over the waistband. The loading of the waist edge of the garment onto the system is detected by a body sensor, such as a photocell or similar detecting means that is mounted along the sewing path. In response, the body sensor actuates an edge guide assembly to engage the waist edge of the garment, and causes the expansion roller frame to be moved further downwardly toward a second operative position to stretch the garment waist edge taut and remove any slack therefrom. Again, the tension roller controls the height of the roller support arm.

An edge guide assembly generally includes a pair of driven toothed guide wheels over which the garment is positioned. A toothed idler wheel is moved into an engaging position with the garment and is biased toward one of the driven guide wheels to assure that the driven guide wheels positively move the garment along the sewing path. A band guide is mounted between the pair of driven guide wheels of the edge guide assembly, and has a recessed, concave surface within which the waistband is received so that the waistband is maintained out of engagement with the driven guide wheels during a sewing operation.

At the start of the cycle of operation, the preferred cycle is initiated and the overlaid garment waist edge and waistband are moved along the sewing path toward the sewing needles of the sewing machine. During this prefeeding cycle, a prefeed guide sensor, a photocell or similar detecting means, is mounted above the sewing path and detects the position of the waist edge of the garment. The prefeed guide sensor controls the operation of the edge guide assembly, causing the guide wheels to be reciprocated so as to move the waist edge of the garment back and forth the across the sewing path into proper alignment with the sewing machine. The prefeed guide sensor adjusts the position of the waist edge of the garment slightly inwardly of the sewing path so as to avoid contact by the waist edge of the garment with the cutter of the sewing machine during the prefeeding cycle.

A seam detector is positioned upstream of the folder assembly and is positioned below the sewing path. The seam detector is dome-shaped in that it is formed with a rounded, substantially semi-spherical shape with a slotted opening formed in the rounded top surface thereof, with the slot oriented at a right angle with respect to the sewing path. The crotch seam of each garment rides up over the upper domed surface of the seam detector and falls or drops into the slotted opening whereupon the presence and position of the seam is detected by the seam detector. Thereafter, the prefeeding cycle is continued for a preset distance along the sewing path, with the waist edge of the garment being progressively folded over the waistband to its full folded position. The prefeeding cycle then is stopped with the crotch seam positioned immediately in front of the needles of the sewing machine, and the sewing operation is started.

A body edge sensor is positioned along the sewing path, adjacent the prefeed sensor and assumes control of the edge guide assembly from the prefeed sensor once the sewing operation has begun. As with the prefeed sensor, the body edge sensor is a photocell or similar detecting means and detects the position of the cut waist edge of the garment along the sewing path and causes the waist edge of the garment to be adjusted laterally across the sewing path to overlap the elastic band far enough to ensure that a proper amount of material of the garment is available to fold about the waistband.

During the sewing operation, a stitch count is recorded from the start of the sewing operation when one end of the crotch seam has reached the sewing needles to the detection of the other end of the crotch seam of the garment by the seam detector. The detection of the other end of the crotch seam indicates that the first half of the sewing operation has been completed. Thereafter, this stitch count is used to control the number of stitches to be formed in the garment during the second half of the sewing operation until completion of guiding of the waist edge of the garment by the edge guide assembly.

As the first sewn portion of the waist of the garment approaches the sewing area for the second time, the edge guide assembly is disengaged and an edge wheel assembly is engaged to maintain the previously folded and sewn waist portion of the garment in the sewing path as the sewing cycle nears completion. The retractable finger portion of the guide support and the folder tongue of the folder assembly are moved laterally out of the sewing path to avoid engagement with the previously sewn portion of the folded waist edge. At the same time, a lift roller is engaged to lift the garment to prevent engagement of the sewn portion of the garment with the guide support and the folder tongue. Upon a third detection of the crotch seam by the seam detector, the sewing cycle is continued for a preset time to enable the sewing of the waist edge to be finished and the threads severed. Thereafter, the completed garment is removed and the system is reset for another sewing operation.

It is therefore an object of the present invention to provide an improved method and apparatus for attaching an uninterrupted looped elastic waistband to the waist edge of a garment such as a pair of pants.

Another object of this invention is to provide an improved method and apparatus for attaching an elastic waistband to a garment, such as a pair of pants, in which the sewing function can be commenced and continued until completion while the worker is free to perform other functions.

Another object of this invention is to provide a method and apparatus for automatically folding and sewing the waist edge of a garment about a looped elastic waistband to encapsulate the waistband within a folded portion of the waist of the garment.

Another object to this invention is to provide a method an apparatus for attaching an elastic waistband to a pair of pants in which the waist edge of the pants is reciprocated back and forth across a sewing path to regulate the folding of the waist edge of the pants about the elastic waistband as the pants are moved along a sewing path of a sewing machine.

Another object of this invention is to provide a system for attaching an elastic waistband to a pair of pants in which a substantially uniform tension is maintained on the garment during the sewing operation and excess tension created in the garment is relieved automatically during the sewing operation without requiring intervention by the operator.

Another object of the invention is to provide improved mechanical devices and controls for handling textile materials during a sewing and/or forming function.

Further objects, features and advantages of the present invention will become apparent upon reading the following specification, when taken in conjunction with the accompanying drawings.

BRIEF DESCRIPTION OF THE DRAWINGS

FIG. 11 is a schematic illustration of the cycle time for the major functions of the system.

DETAILED DESCRIPTION

Figure 1A:
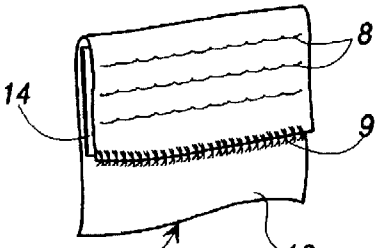
FIG. 1A is a perspective illustration of a small portion of the waistband of a pair of pants, showing how the waist edge of the pants is folded over and sewn to the elastic waistband.

Referring now in greater detail to the drawings, in which like numerals indicate like parts throughout the several views, FIG. 1A illustrates a portion of a garment 10 having an elastic waist portion that is to be formed by the elastic waistband attachment system. A portion of the waist of the garment is folded about the elastic waistband and is sewn to it with stitches 8, which in this embodiment are 401 chain stitches, and stitch 9 which is a 406 bottom cover stitch.

Figure 2:
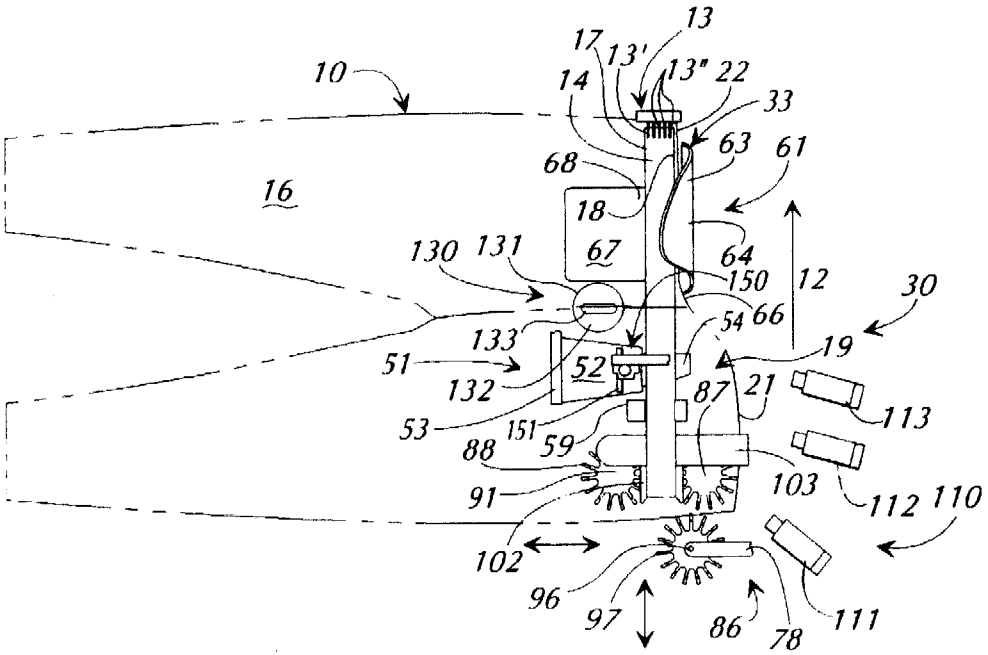
FIG. 2 is a schematic illustration of how the waist edge of the pants is folded about an elastic waistband and sewn thereto, showing schematically how the parts are guided and sewn together.
Figure 1B:
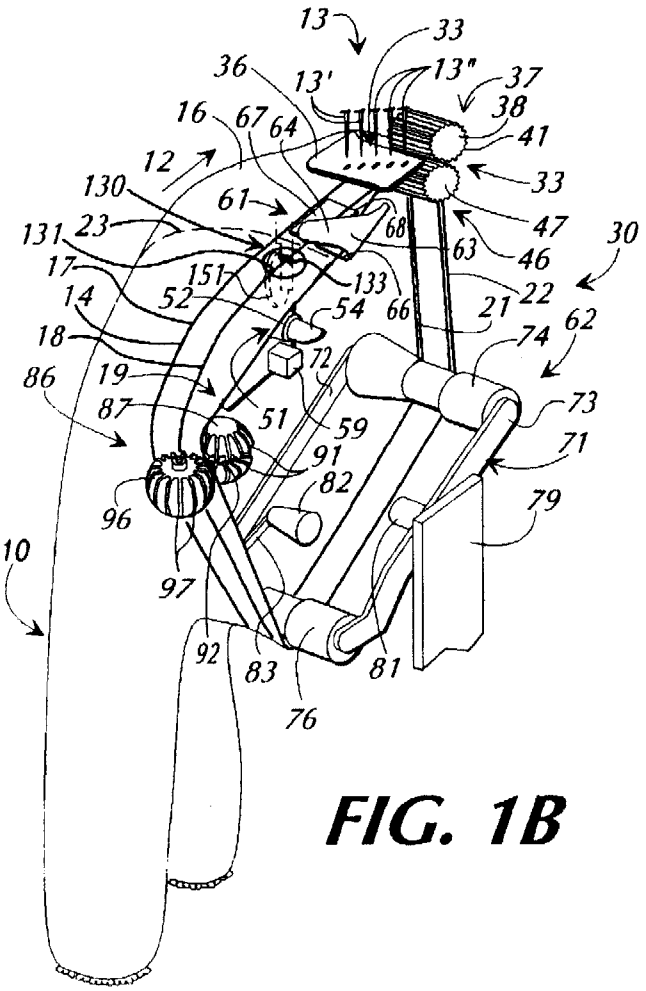
FIG. 1B is a perspective illustration of a pair of pants and an elastic waistband generally showing how the waist edge of the pants is folded over and sewn about the elastic waistband.

FIG. 1B illustrates the garment 10 that is moved along a substantially circular, looped sewing path, shown by arrows 12, into engagement with a series of sewing needles 13 of a sewing machine. The garment is comprised of parts including a knitted, continuous loop elastic waistband 14 and an article of clothing such as a sweat shirt or a pair of pants 16 formed from a cotton fleece, jersey or woven material. As shown in FIGS. 1B and 2, the waistband is formed from a stretchable material with its ends sewn to form a continuous loop and includes side edges 17 and 18. The elastic waistband material can be of varying widths depending on the desired width of the elastic waist of the finished garment. The pants include waist portion 19 having a cut waist edge 21 that is folded under the waist portion 19 of the pants along the length of the waist portion, as shown by 22, and a crotch seam 23 (shown in dashed lines) that extends normal to the waist edge of the garment.

After the elastic waistband has been loaded into the sewing path 12, the operator places the waist edge 21 of the pants in telescoped relationship about the waistband with the waist edge overlapping the outermost side edge 18 of the waistband. The waist edge 21 of the pants typically overlaps side edge 18 of the waistband by an amount corresponding to the desired width of the waistband, with the amount of overlap typically being approximately 1 inch, although greater or lesser amounts of overlap can be used as desired, depending on the size of the waistband and the amount of fold in the waist of the pants desired. As shown in FIG. 2, the waistband 14 and pants 16 are moved along the sewing path 12 toward the sewing needles, along which the waist edge of the pants is progressively folded under and across the waistband prior to engagement by the sewing needles. As the waistband and pants are moved along the sewing path 12, the waist edge 21 of the pants is progressively folded down and over the waistband and trimmed and sewn during a sewing operation, encapsulating the waistband within the folded portion 22 of the waist of the pants.

Typically, the garment is engaged by a series of five sewing needles, with the two leftmost sewing needles 13' forming the 406 bottom cover stitch 9 (FIG. 1A) through the garment, so that the waist edge of the pants is covered and oversewn, and with the three rightmost needles 13" forming the conventional 401 chain stitch 8 through the waist portion of the pants and the waistband to secure the waistband within the folded portion 22 of the pants. This prevents the waistband from twisting or curling. A conventional trimmer or cutter (not shown) progressively cuts any portion of the cut waist edge of the pants that overlies the sewing path away from the garment parts, thereby assuring that the finished garment has a neatly oversewn, finished inner edge. As the sewing operation is completed, the needle threads are severed by the cutter close to the cut waist edge of the pants to give the pants a finished appearance.

Figure 3:
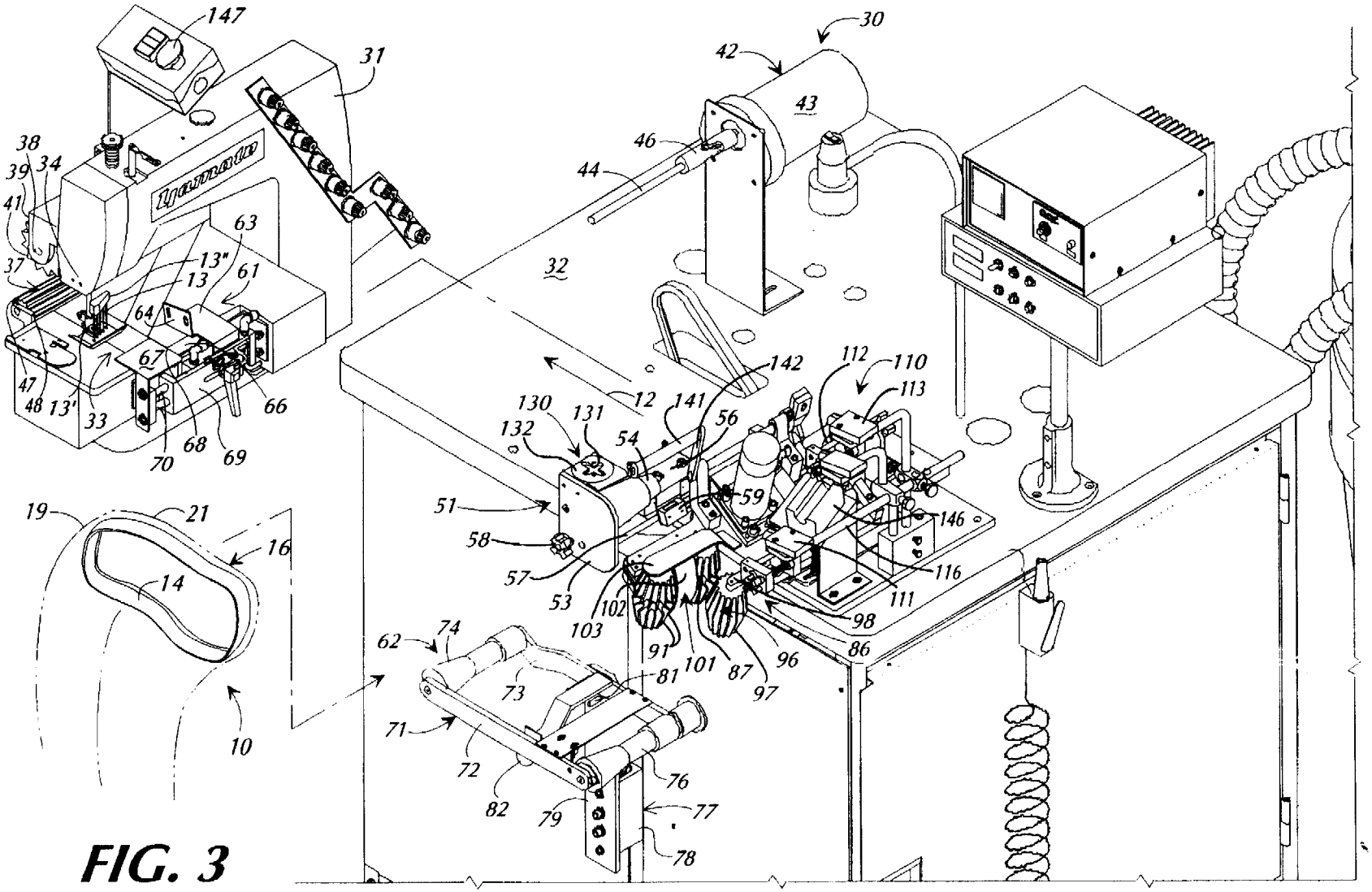
FIG. 3 is a perspective illustration of the elastic waistband attachment system, showing the sewing machine displaced from the attachment system.
Figure 4:
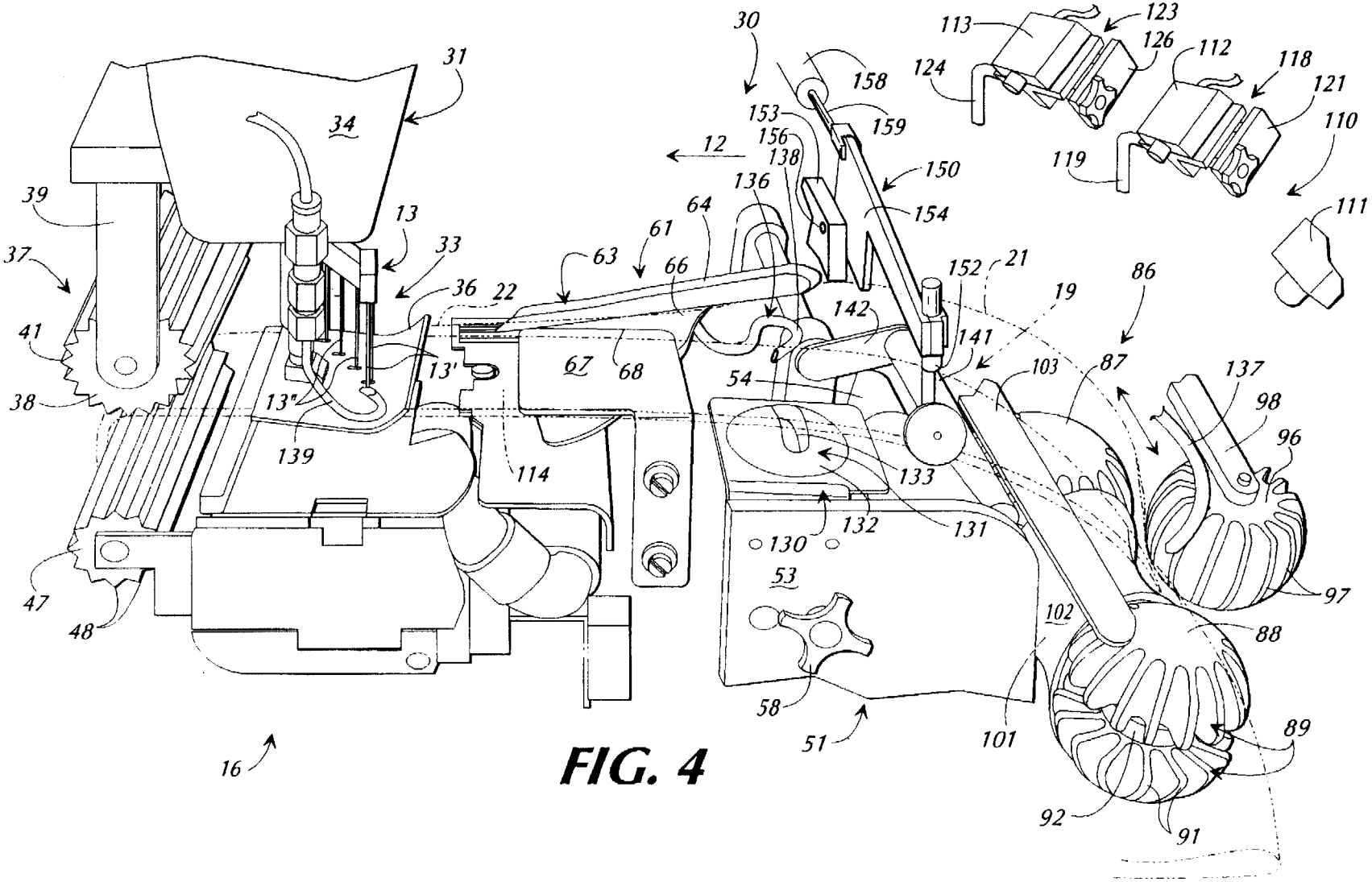
FIG. 4 is a perspective illustration of the sewing area of the system of FIG. 3, illustrating the garment puller to the left of the sewing machine, and the guide support assembly, seam detector and edge guide assembly of the system to the right of the sewing machine.

As generally illustrated in FIGS. 3 and 4, wherein the operative components are shown for performing the functions illustrated in FIGS. 1–2, the waistband attachment system 30 includes a sewing machine 31 mounted on a work table 32 for the elastic waistband attachment system at a sewing area 33. The sewing machine 31 includes a sewing head 34 positioned above the sewing path and which includes the sewing needles 13, loopers (not shown) and the presser foot 36 of the sewing machine. A series of threads are supplied to the sewing needle and loopers from thread supply reels (not shown) for forming the bottom cover stitches and chain stitching (FIG. 1). A cutter (not shown) is mounted below the sewing area 33 (FIG. 3) adjacent the loopers of the sewing machine for trimming the cut waist edge of the pants as the waist edge is oversewn with bottom cover stitches to give the waist edge a trimmed appearance.

Figure 5:
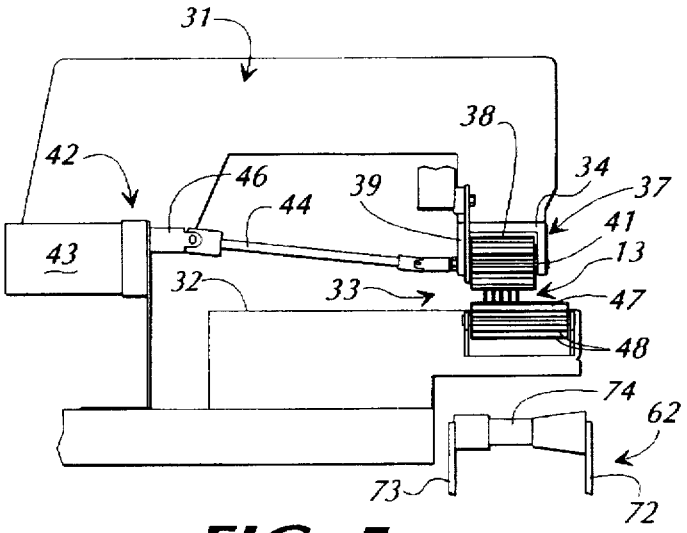
FIG. 5 is an end view of the sewing machine, illustrating the drive mechanism for pulling the work product about the sewing path during a sewing operation.

As generally illustrated in FIGS. 3, 4 and 5, a garment puller 37 is mounted to the sewing machine 31 behind the sewing area 33 above the sewing path in an operative relationship with respect to the sewing head 34 and sewing needles 13. The garment puller includes a puller wheel 38 rotatably mounted to the sewing machine by a yoke or bracket 39. The puller wheel is a cylindrically-shaped roller having a series of teeth 41 formed about its circumference and is mounted above the sewing path in a position adapted to engage and move the garment parts along the sewing path. The puller wheel is connected to the drive mechanism of the sewing machine and generally is driven by the operation of the sewing machine during sewing of the garment parts. An additional drive means 42 further is releasibly connected to the puller wheel for rotating the puller wheel independently of the operation of the sewing machine.

As illustrated in FIG. 5, the drive means 42 includes a jog motor 43 mounted on the work table 32 adjacent the sewing machine 31. The jog motor 43 is actuated at the start of the pre-feeding cycle and drives the puller wheel during the pre-feeding cycle. The drive means 42 further includes an axle or drive shaft 44 connected to the puller wheel, and a universal joint 46 at the opposite end of the drive shaft and having a clutch bearing therein, which connects the drive shaft, and thus the puller wheel, to the motor. The universal joint connector enables the drive shaft to spin independently of the operation of the jog motor 43 during a sewing operation as the puller wheel is rotated by the sewing machine. An idler roller 47 is mounted below the sewing path, aligned with the puller wheel 38. Like the puller wheel, the idler roller is cylindrically-shaped and has a series of teeth 48 about its circumference. The garment parts are engaged between the teeth 41 of the puller wheel 38 and the teeth 48 of the idler roller 47 during a sewing operation and are pulled along the sewing path with the rotation of the puller wheel.

As shown in FIGS. 2, 3 and 4, a guide support assembly 51 is mounted along the sewing path upstream from the sewing area 33. The guide support assembly includes a support base portion 52 mounted to a vertical support 53 and extending laterally across the sewing path. A retractable guide finger 54 is received telescopically within the support base and is extensible laterally across the sewing path, moving between an extended, operative engaging position for supporting the waistband 14 and a retracted, non-operative position out of engagement with the waistband as a finished portion of the garment moves along the sewing path toward the sewing area at the completion of a sewing cycle. The retractable guide finger 54 is mounted to a pneumatic cylinder assembly 56 (FIG. 6), which includes a pair of piston rods 57 that are mounted to a support bracket (not shown) for the retractable guide finger. The piston rods of the cylinder assembly are retracted prior to the loading of the garment parts on the system to extend the guide finger across the sewing path into its operative position for supporting the waistband. The piston rods are extended as the sewing cycle nears completion to cause the guide finger to be retracted out of the sewing path and away from engagement with a finished portion of the garment. As FIG. 4 illustrates, the position of guide support assembly can be adjusted laterally across the sewing path by the adjustment of a knob 58, depending on the size of the garment being sewn.

Figure 6:
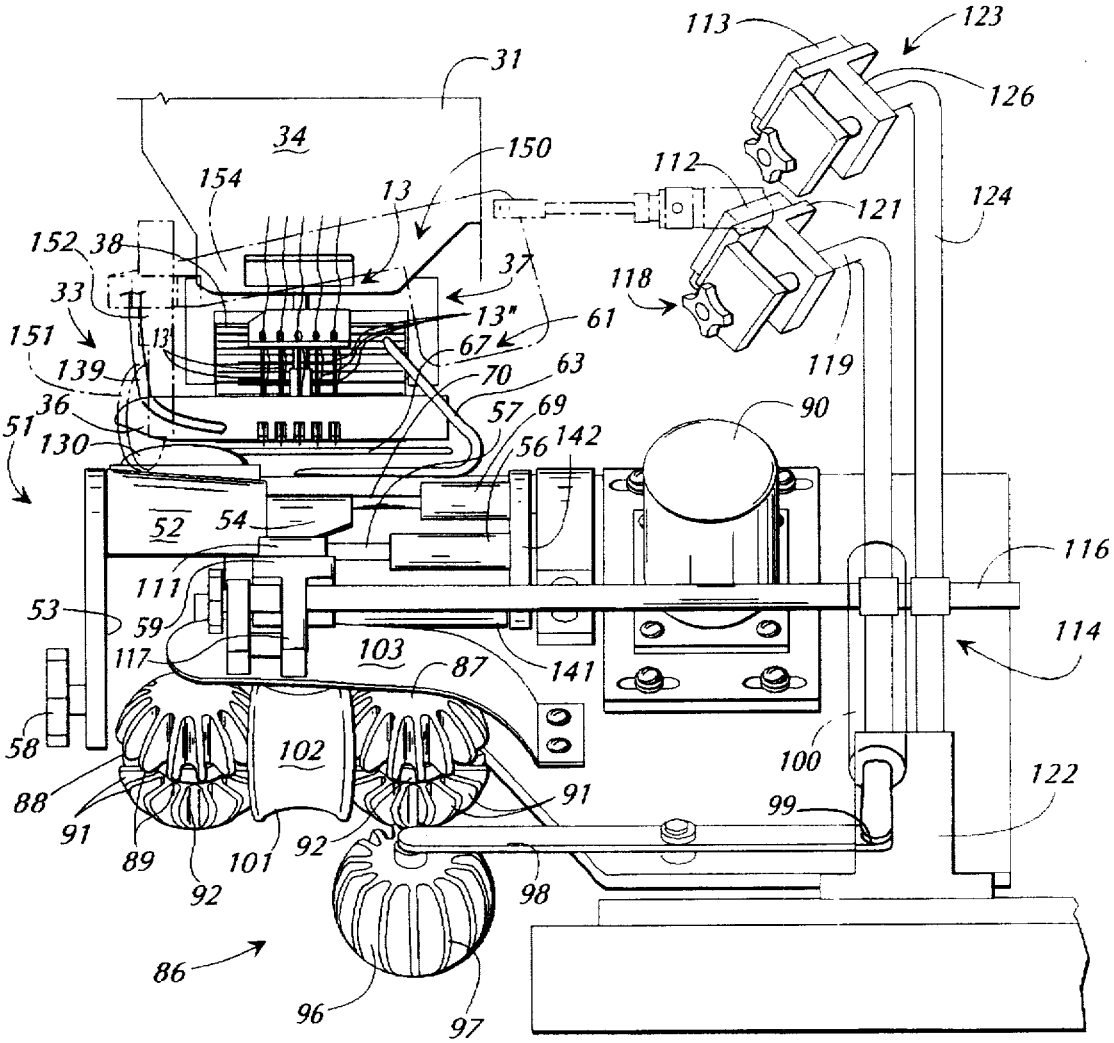
FIG. 6 is an end view of the waistband attachment system opposite to FIG. 5, facing the sewing area thereof.

As shown in FIGS. 2, 3 and 6, a band sensor 59 is mounted adjacent and upstream from the guide support assembly, positioned directly below the sewing path. The band sensor typically is a photo-electric sensor or similar detecting means focused at the sewing path. The band sensor detects the loading of the waistband into the sewing path prior to the start of a sewing operation, as the waistband crosses and covers the beam of the band sensor. In response to the detection of the waistband being loaded onto the system, the band sensor 59 actuates an expansion roller assembly 62 (FIG. 3), causing the assembly to move into engagement with the waistband. The band sensor further acts as a fail safe means for preventing the start of operation of the system until the waistband is positioned properly within the sewing path.

As illustrated in FIG. 3, the folding assembly 61 is mounted to the work table of the sewing machine 31 immediately upstream from the sewing area 33. The folding assembly includes a stationary folder bracket or plate 63 mounted along the right side of the sewing path in a position to engage the waist edge 21 (FIG. 2) of the pants 16 as the pants are pulled along the sewing path. The stationary folder bracket or plate typically is formed from a metal such as steel, having a smooth, polished surface and generally is formed with a curved or substantially C-shaped configuration having an upwardly sloping portion 64 that projects above the sewing path, and a downwardly sloping portion 66 that curves inwardly toward and projects below the sewing path. A moveable folder tongue 67 (FIG. 4) is mounted on the opposite side of the sewing path from the stationary folder plate 63. The folder tongue generally is a substantially square-shaped plate formed from a metal such as steel or a similar-type material having a smooth, flat upper surface, and includes a front edge 68 about which the waist portion of the pants is folded over and about the waistband.

The folder tongue 67 (FIGS. 4 and 6) is movable from an initial engaging position, to a non-engaging position. In its engaging position, the folder tongue extends across the sewing path, positioned adjacent the stationary folder plate approximately between upwardly and downwardly cylindrical portions thereof. As the waist edge 21 (FIG. 2) of the pants 16 is moved along the sewing path 12, the pants waist portion 19 engages the stationary folder plate 63 and the front edge 68 of the folder tongue of the folding assembly 61. Such engagement tends to the urge the waist edge downwardly so that the waist portion 19 of the pants is wrapped or folded over the front edge 68 of the folder tongue 67, overlapping and encapsulating the waistband. A cylinder assembly 69 (FIG. 6) is mounted below the stationary folder plate 63, and includes piston rods 70 that are attached at their free ends to a support for the folder tongue 67. The cylinder assembly retracts and extends its piston rods to move the folder tongue into and out of its engaging, operative position.

As shown in FIGS. 3, 7, and 8A–8C, the expansion roller assembly 62 includes roller frame 71, comprising a pair of parallel spaced frame supports 72 (FIG. 7) 73, and expansion rollers 74 and 76 mounted at the opposite ends of the frame supports 72 and 73. The frame supports typically are formed from a metal such as steel or a similar rigid material, and the expansion rollers typically are formed from nylon or a similar material. The waistband and waist of the pants are loaded about and are engaged by the expansion rollers at the start of a sewing operation. During the sewing operation, the waistband and waist of the pants are stretched and placed under tension by the vertical movement of the roller frame.

Figure 7:
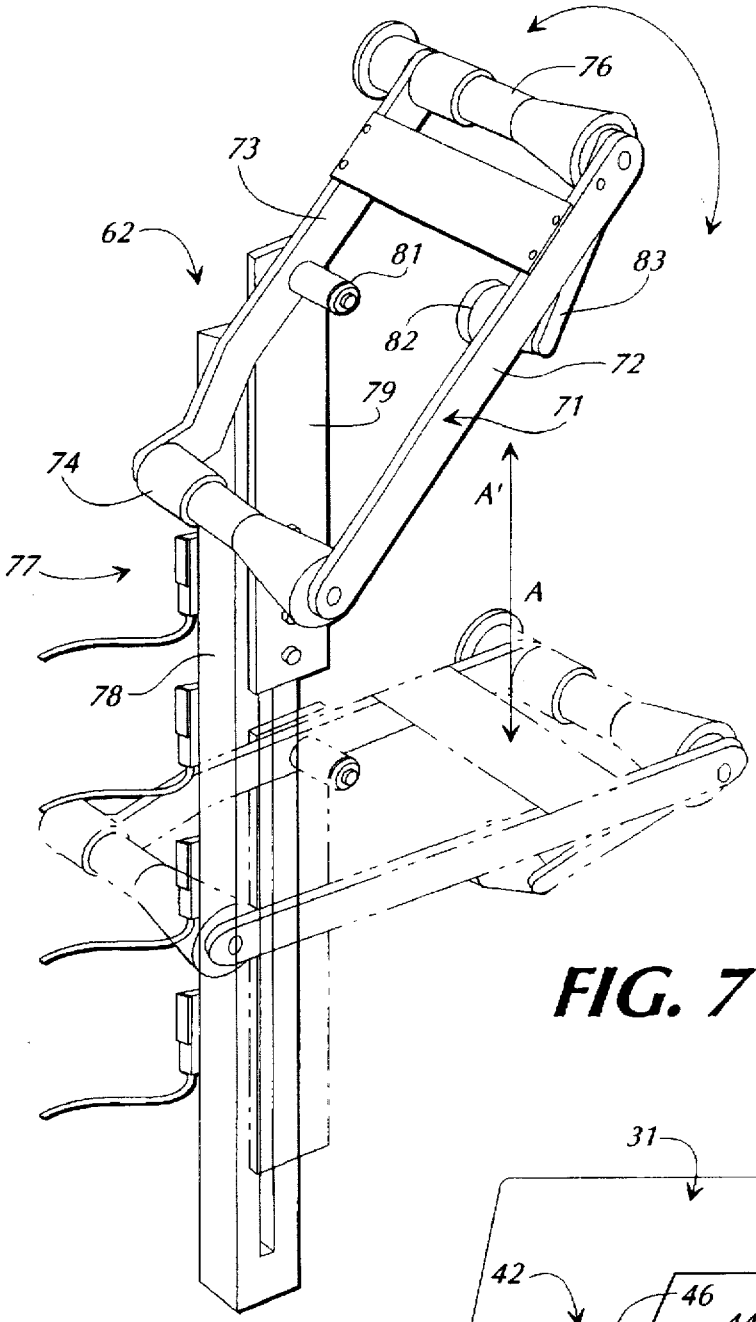
FIG. 7 is a perspective illustration of the expansion roller assembly.

The expansion roller frame 71 is pivotally mounted to a pneumatic cylinder assembly 77 for moving the expansion roller frame vertically. As FIG. 7 illustrates, the cylinder assembly 77 generally includes a vertically oriented "rodless" cylinder 78 having a carriage 79 movable along the length thereof and a series of limit switches along its length, for setting the limits of the travel of the carriage 79. The roller frame 71 is mounted to the carriage 79 by a pivot pin 81 that extends through and pivotally supports the frame supports 72 and 73 to enable the roller frame to tilt vertically. The cylinder assembly is actuated first by the loading of the waistband onto the system by the detection of the waistband being moved into the sewing path by the band sensor 59 (FIG. 6). In response, the roller frame is moved downwardly to a first position, shown in dashed lines in FIGS. 7 and 8A, by stretching the waistband to an initial tension to remove any slack therefrom. Thereafter, upon the loading of the waist edge of the pants onto the system, the roller frame is moved further downwardly to a second position, as indicated in FIG. 7, further stretching the waistband and tensioning the waistband and tensioning the waist of the pants. It further will be understood that while the expansion roller assembly is shown as using a pneumatic cylinder assembly for moving the roller frame vertically, other types of drive means can be used, such as, for example, a travel screw with a reciprocating motor, can be used in place of the rodless cylinder 78 (FIG. 7).

Figure 8A:
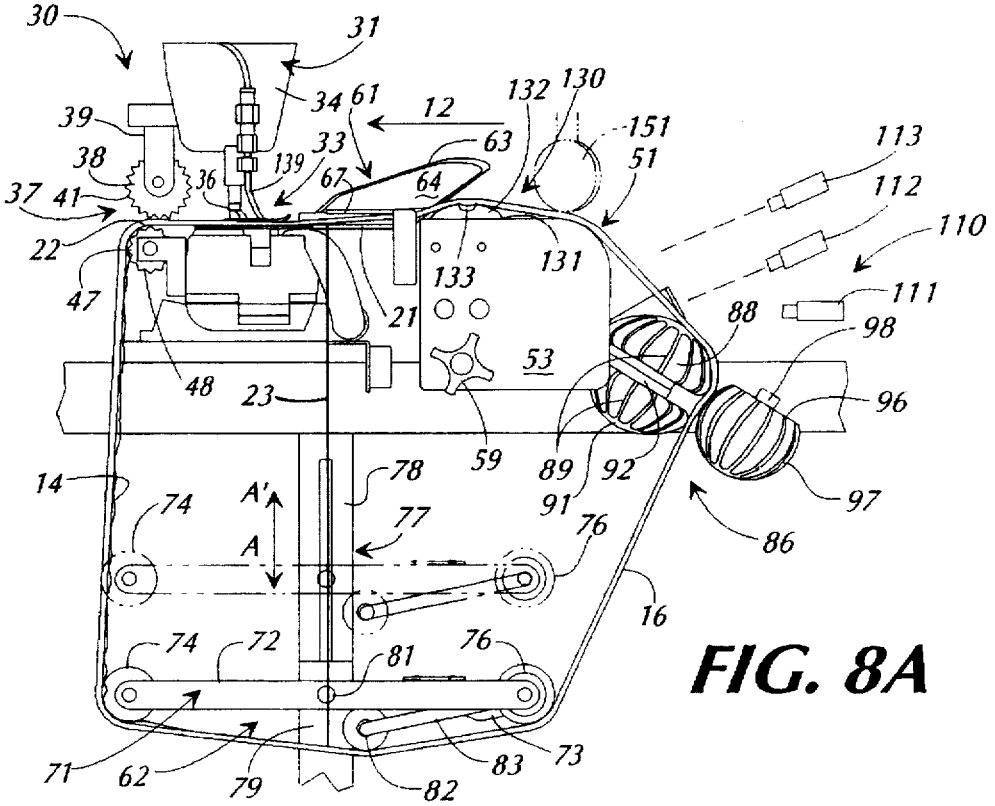
FIG. 8A is a schematic illustration of the stretching of the garment parts by the expansion roller assembly at the start of a sewing operation.
Figure 8B:
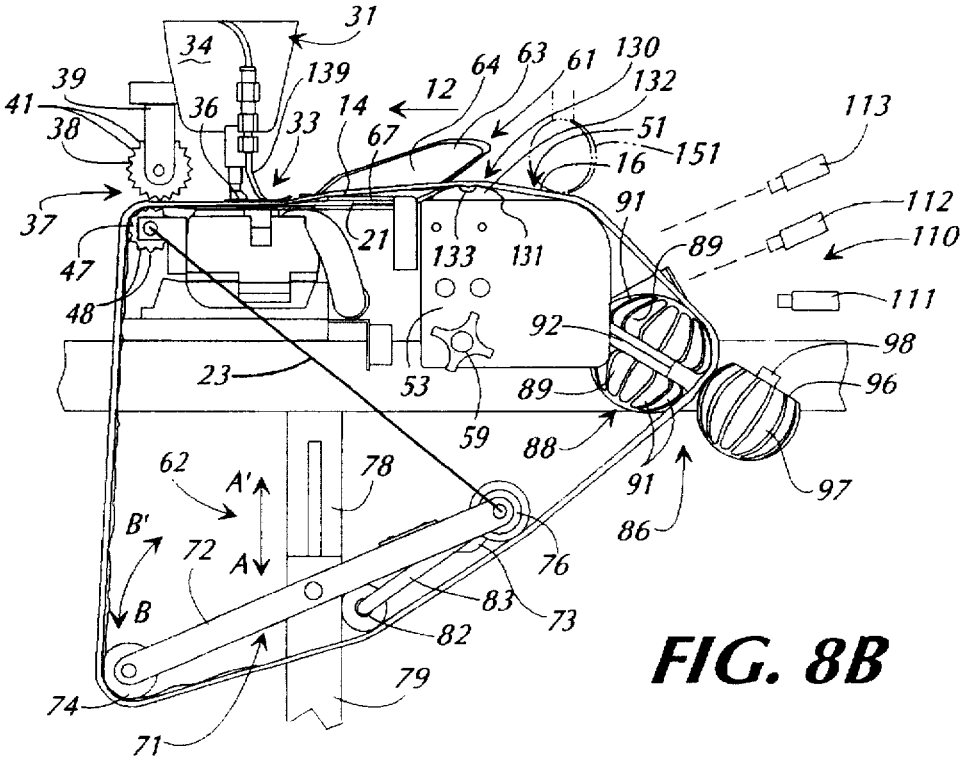
FIG. 8B is a schematic illustration similar to FIG. 8A, showing the tilting of the expansion roller assembly forwardly to equalize tension from the garment as one end of the crotch seam of the pants passes the sewing needles.
Figure 8C:
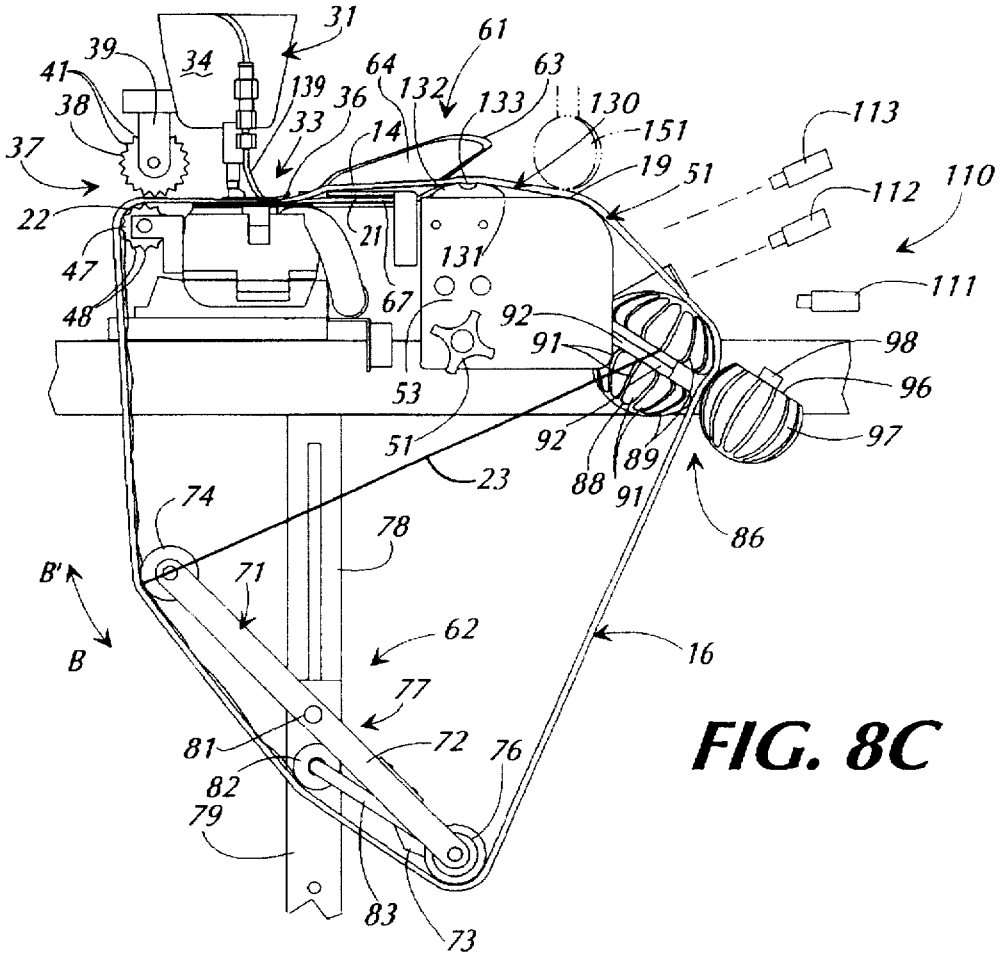
FIG. 8C is a schematic illustration similar to FIG. 8A, showing the tilting of the expansion roller assembly rearwardly to equalize tension in the garment as the other end of the crotch seam approaches the sewing needles.

As illustrated in FIGS. 7 and 8C, the expansion roller assembly 62 further includes a tension roller 82 movably mounted to frame support 73 of the expansion roller frame 71 by a pivot arm or lever 83. As indicated in FIGS. 8A–8C, as the position of the crotch seam 23 of the pants 16 changes due to the movement of the waist portion of the pants about the sewing path, the tension applied to the waist of the pants is increased due to the restriction of the amount of stretch on the waist of the pants by the crotch seam. This increased tension in turn causes the waist portion of the pants to tighten against and urge the tension roller 82 upwardly as indicated in FIG. 8A. In response, the roller frame is raised slightly to relieve the excess tension momentarily being placed upon the waist portion of the pants. Upon lessening of the tension on the waist portion of the pants due to the continued movement of the pants waist and crotch seam about the sewing path, the tension roller is released and the roller frame is returned to its normal operative position for stretching the waistband and the waist of the pants.

Figure 9:
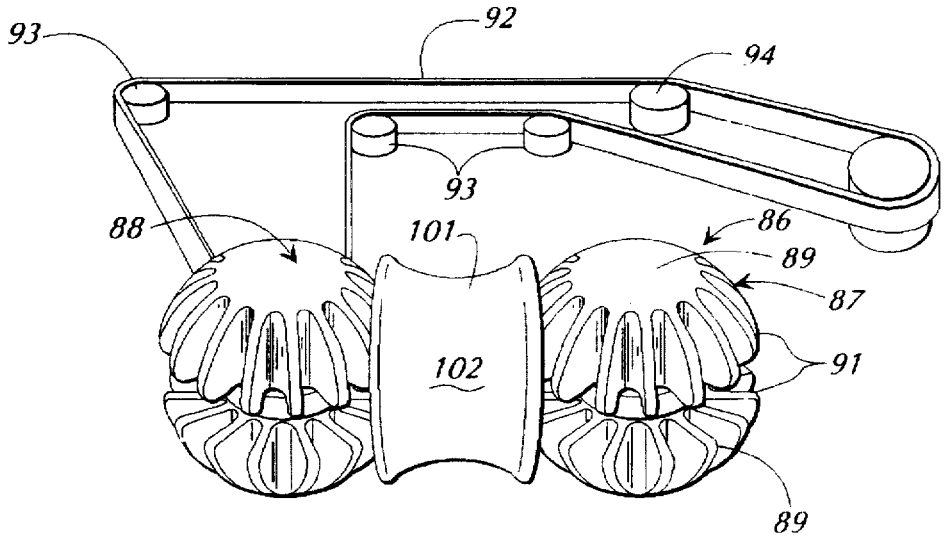
FIG. 9 is a perspective illustration of the drive mechanism for the guide wheels of the edge guide system.

As FIGS. 3, 4 and 6 illustrate, an edge guide assembly 86 is provided at the upstream end of the elastic waistband attachment system 30 for controlling the position of the waist edge 21 (FIG. 2) of the pants in the sewing path 12. The edge guide assembly 86 (FIGS. 2, 3, 4 and 6) includes a pair of approximately spherical drive wheels 87 and 88, mounted on opposite sides of the sewing path and rotated by a rotary drive motor 90 (FIG. 6) which in this embodiment is a stepping motor. Each of the drive wheels generally includes a pair of hemispheres 89 (FIG. 6) mounted on a drive shaft, spaced from one another, with each drive wheel including a series of radially extending ridges or teeth 91 formed about their circumference. As shown in FIG. 9, a drive belt 92 is encircled about the drive shafts of the drive wheels and about a series of idler rollers 93 in a substantially serpentine path. The drive belt 92 further is encircled about a drive roller 94 of drive motor 90 (FIG. 6). Drive roller 94 (FIG. 9), which is mounted to a reversible stepping motor, is rotated in an oscillating motion to move the drive belt back and forth about the idler rollers. In turn, this back and forth movement of the drive belt 92 causes the rotation of the drive wheels in a clockwise and/or counterclockwise oscillating motion. This oscillation of the drive wheels urges the waist portion of the pants back and forth in a reciprocating motion across the sewing path to align the waist edge of the pants for folding and sewing.

An idler wheel 96 is mounted adjacent and slightly upstream from drive wheel 87, as shown in FIGS. 3, 4 and 6. The idler wheel 96 generally is substantially a spherically shaped ball having a series of ridges or teeth 97 formed about its circumference and adapted to engage and mesh with the teeth 91 of drive wheel 87. The idler wheel is mounted on one end of a pivoting support arm 98 (FIG. 6), which itself is pivotally mounted between its ends, and its other end 99 is connected to an air cylinder assembly 100 to move the idler wheel into and out of engagement with the pants. The pivoting support arm 98 is pivoted adjacent its end 99, in response to the loading of the waist of the pants onto the waistband attachment system, causing the idler wheel 96 to be moved from an initial, non-engaging position spaced from drive wheels 87 and 88, as indicated in FIG. 4, into an operative position with the teeth 97 of the idler wheel in meshing engagement with the teeth 91 of drive wheel 87.

The waist portion of the pants is engaged between the teeth of the idler wheel and drive wheel 87 such that as drive wheel 87 is rotated, the waist edge of the pants is reciprocated back and forth across the sewing path to maintain the waist edge in a desired alignment along the sewing path. Additionally, the air cylinder assembly 100 for the support arm includes an air regulator to regulate the pressure in the cylinder to enable the idler wheel to be biased away from drive wheel 87 when the crotch seam passes between the drive wheels and idler wheel to avoid engagement and tangling of the material of the pants between the idler wheel and drive wheels.

As illustrated in FIGS. 6 and 9, a waistband guide 101 for guiding the elastic waistband 14 is mounted between the spherical drive wheels 87 and 88. The waistband guide generally is a rotatable concave sheave having a concave annular working surface 102 in which the waistband is received and rides as the waistband is pulled along the sewing path, as shown in FIG. 2. As a result, the concave sheave 101 keeps the waistband from being engaged by the teeth of the drive wheels as the drive wheels rotate and pull the waist of the pants back and forth across the sewing path. The concave annular working surface of the waistband guide sheave 101 is of smaller circumference than the circumferences of the adjacent spherical drive wheels 87 and 88 (see FIG. 2), so that the elastic band will pass inside the pants material without engaging the pants material. This allows the pants to be shifted back and forth by the spherical drive wheels 87 and 88 across the waistband 14 without moving the waistband laterally.

As shown in FIGS. 2, 4 and 6, a guide tongue 103 is mounted to the work table 32 (FIG. 6) and comprises a curved bar or strip of metal that extends over the spherical drive wheels 87 and 88 and waistband guide sheave 101 of edge guide assembly 86. When the waistband 14 and pants 16 leave the spherical drive wheels 87 and 88 and the concave sheave 101, they ride over the guide tongue, which prevents the material of the waistband and pants from dropping into and becoming engaged by the teeth of the drive wheels and jamming the system. The guide tongue 103 further includes a strip of reflective tape applied thereto for reflecting the beams of sensor means for controlling the sewing operation of the system.

A body sensor array 110 (FIGS. 2, 3, 4 and 6) is positioned at the downstream end of the sewing path 12 for detecting and controlling the position of the waist edge 19 (FIG. 2) of the pants 16 in the sewing path. The body sensor array includes a body detector 111, prefeed guide sensor 112 and a body edge sensor 113. As FIG. 6 illustrates, the body detector is a photocell or similar detecting means positioned in alignment with the sewing path downstream from the edge guide assembly 86. An adjustable mounting 114 is provided for supporting the body detector in its position aligned with the sewing path. The adjustable mounting 114 for the body detector includes a horizontally oriented support rod 116 and a mounting block 117, to which the body detector 111 is mounted, and which is adjustably attached to the support rod 116. The mounting block 117 is moved along the length of the support rod 116 to adjust the position of the body detector 111 horizontally with respect to the sewing path to orient the body detector into a desired position above the sewing path. The body detector 111 is focused at the sewing path, at the piece of reflector tape applied to the guide tongue 103, and detects the loading of the waist of the pants onto the system as the waist edge of the pants crosses the beam of the body detector. In response, the body detector causes the idler wheel 96 of the edge guide assembly 86 to be moved into its operative position adjacent drive wheel 87 and additionally causes the expansion roller frame 71 of the expansion roller assembly 62 to be moved further downwardly to its second operative position to tension the waist of the pants and remove any slack therefrom.

As shown in FIGS. 4 and 6, the prefeed guide sensor 112 is mounted onto the right side of the sewing path, focused downwardly at an angle toward the approximate position of the waist edge of the pants in the sewing path. The prefeed guide sensor is supported above the sewing path on an adjustable mounting 118 (FIG. 6). The mounting 118 includes an L-shaped support rod 119 and a mounting block 121 adjustably mounted to the support rod 119 and to which the prefeed guide sensor is mounted The support rod 119 is mounted to the work table by an adjustable mount 122 that enables the support rod to be moved vertically to adjust the position of the prefeed sensor vertically, and the mounting block 121 is adjustably mounted on a horizontally extending portion of the support rod to enable the position of the prefeed guide sensor to be adjusted laterally across the sewing path.

The prefeed guide sensor is engaged at the start of the sewing operation during the prefeeding cycle of the garment. During the prefeeding cycle, the prefeed guide sensor 112 detects the position of the waist edge 19 (FIG. 2) of the pants 16 and controls the operation of the edge guide assembly 86 to cause the waist edge of the pants to be moved laterally toward the left side of the sewing path approximately ⅞ of an inch during the jog or prefeeding cycle. As a result, as the waist edge of the pants is folded over during the prefeeding cycle, the waist edge is kept out of engagement with the trimmer or cutter of the sewing machine during the initial prefeeding cycle, during which the sewing machine is not operating, to avoid the material of the pants becoming caught in the cutter and to prevent an untrimmed portion of the pants from being sewn and to prevent jamming, curling or disrupting the operation of the elastic waistband attachment system. Once the prefeeding cycle has been completed and the presser foot drops at the start of a sewing operation, the edge guiding function is switched from the prefeed guide sensor 112 to the body edge sensor 113 for control of the position of the waist edge during the sewing operation.

As illustrated in FIGS. 4 and 6, the body edge sensor 113 is positioned adjacent and slightly upstream from the prefeed guide sensor 112, directed downwardly toward the sewing path and focused at the waist edge of the pants. Like the prefeed guide sensor 112 (FIG. 6), the body edge sensor 113 is supported above and along the sewing path by an adjustable mounting 123. The adjustable mounting 123 comprises a substantially L-shaped support rod 124, having an adjustable mounting block 126 attached to a horizontally extending upper portion thereof. Support rod 124 is attached at its lower end to the mount 122 that enables the support rod to be moved vertically to adjust the vertical position of the body edge sensor 113. The horizontal position of the body edge sensor is adjusted by the adjustment of the mounting block 126 on the horizontally extending upper portion of support rod 124 as shown in FIG. 6. The body edge sensor 113 controls the edge guide assembly during a sewing operation, causing the drive wheels of the edge guide assembly to be rotated in a reciprocating fashion to pull and push the waist edge of the pants across the sewing path. As a result, the waist edge of the pants is maintained at a desired position in the sewing path, which ensures that the proper amount of fold is formed in the pants to cover the waistband and creates a uniform folded waist edge about the pants. The body detector 111 further detects the absence of an unfolded edge of the pants in the sewing path, which signals that the sewing operation is nearing completion.

As illustrated in FIGS. 2, 3, and 4, a seam sensor 130 is positioned downstream from the body sensor array 110, positioned between the guide support assembly 51 and the folding assembly 61. The seam sensor 130 generally includes a photoelectric cell or similar sensing means (not shown) positioned below and directed upwardly toward the sewing path. A domed cover 131 is positioned over the detector, and has a curved, smooth upper surface 132 having a elongated slot 133 formed laterally thereacross. As one end of the crotch 23 of the pants 16 approaches the sewing area 33, the crotch seam tends to ride over the upper surface 132 of the cover 131 and drop into the slot 133. The dropping of the crotch seam into the slot 133 is detected by the detector. In response to the detection of the crotch seam, the seam sensor 130 engages a stitch counter at the start of a sewing operation, and determines the end of the stitch count upon detection of the second portion of the crotch seam passing thereover. The stitch count provides an indication as to the size of one-half of the garment. The stitch count also is used to determine the end of the guiding of the waist edge by the edge guide assembly when the stitch count again is reached in order to disengage the edge guide assembly as the completion of the sewing cycle approaches.

As shown in FIG. 4, a decurling means is provided for the elastic waistband attachment system for removing any curl formed in the waist edge of the pants that might occur in response to the tensioning of the waist of the pants. The decurling means generally comprises a series of air nozzles 137, 138 mounted along the sewing path 12. As shown in FIG. 4, air nozzle 137 is mounted to the support arm 98 of the idler wheel 96 and is moved into position in the sewing path with the movement of the idler wheel toward its drive wheel 87, while air nozzle 138 is positioned slightly upstream from the folding assembly. Air nozzles 137 and 138 direct a flow of pressurized air downwardly at an angle toward the waist edge of the pants, causing the waist edge to be urged downwardly and to uncurl. The action of air nozzle 138 directly upstream from the folding assembly further helps cause the waist edge of the pants to be folded downwardly and over the waistband as it passes through the folding assembly 61. An additional air nozzle 139 is mounted adjacent the leftmost sewing needles 13" for lifting the threads above the presser foot after the completion of sewing.

A lift roller 141 is mounted between the edge guide assembly 86 and the guide support assembly 51, as illustrated in FIGS. 3 and 4. The lift roller is a substantially cylindrically and is rotatably mounted to a pivot arm 142 that pivots the lift roller in an arcuate motion from a lowered, non-engaging position into a raised engaging position. In its engaged position, the lift roller lifts the garment upwardly and prevents the previously sewn portions of the garment from engaging the guide support assembly.

A finger swipe switch 146 (FIG. 3) is mounted to the worktable 32 for the elastic waistband attachment system 30, positioned adjacent the edge guide assembly 86. The finger swipe switch controls the starting of the elastic waistband attachment system. Once the garment parts have been loaded on the system, and are in proper alignment, the operator simply wipes his or her finger along the swipe switch to initiate the operation of the system. An emergency stop switch 147 is mounted above the sewing machine 31 for stopping the operation of the elastic waistband attachment system. Foot controls (not shown) also are provided for controlling the various functions and operative elements of the elastic waistband attachment system, such as the sewing function of a sewing machine, etc.

Figure 10A:
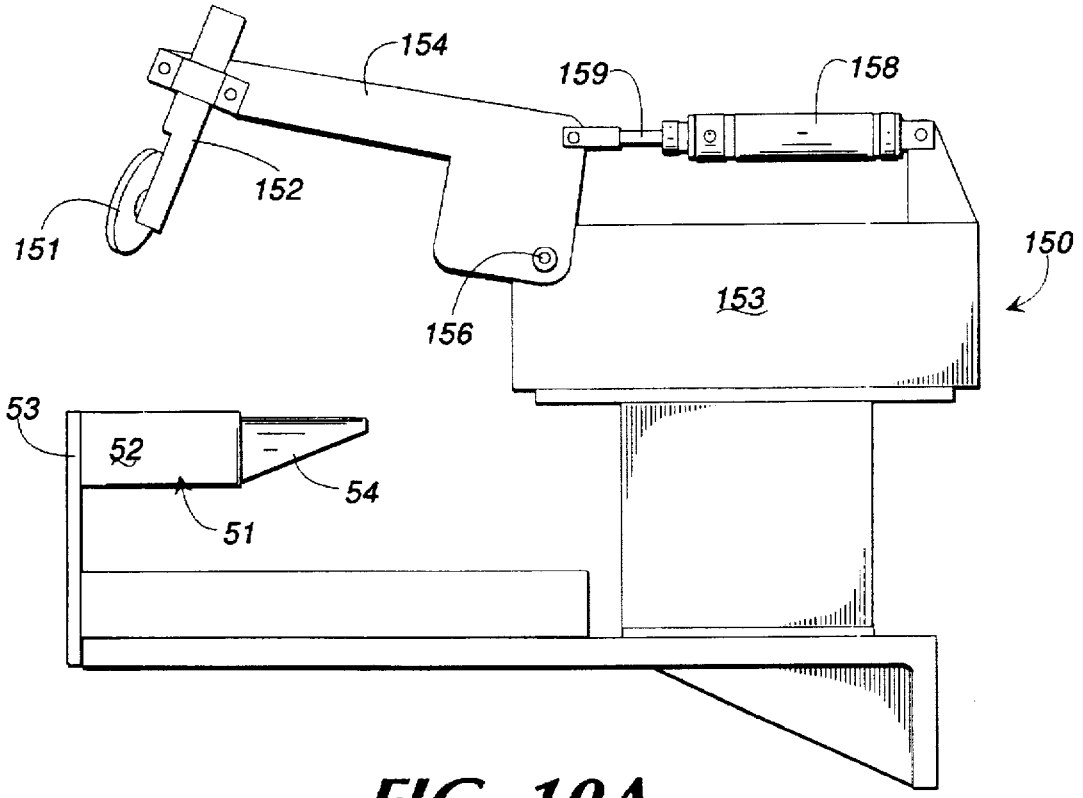
FIG. 10A is a side elevational view of the edge wheel assembly with the edge guide wheel in its raised non-engaging position.
Figure 10B:
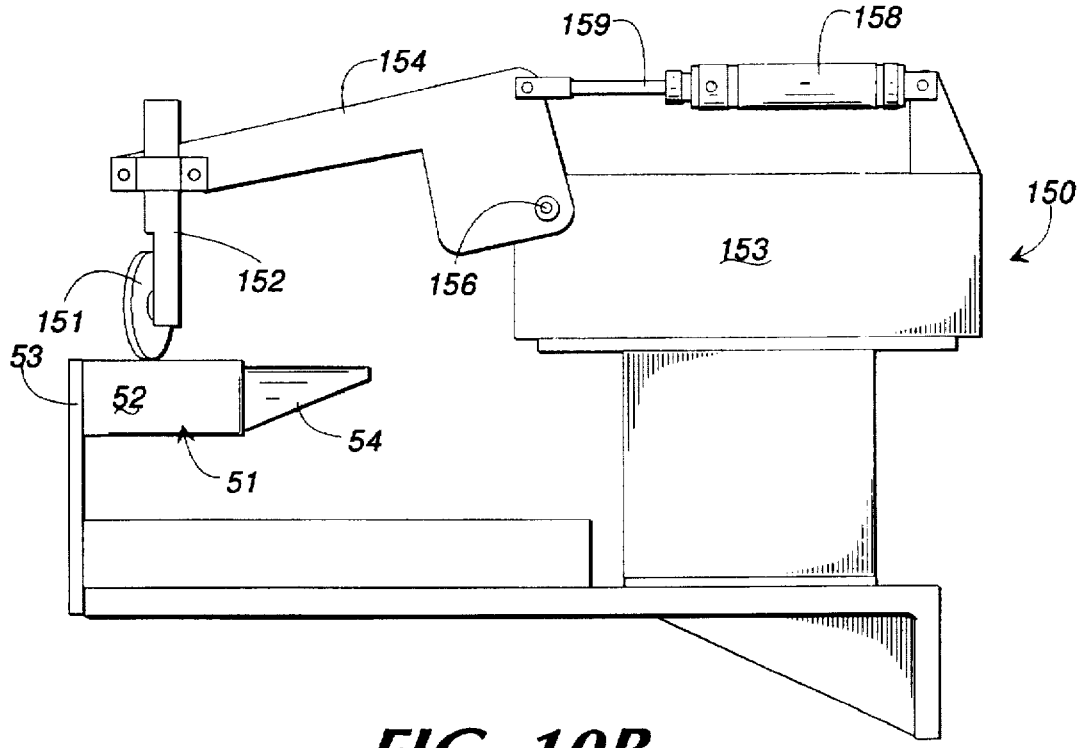
FIG. 10B is a side elevational view of the edge wheel assembly with the edge guide wheel in its lowered engaging position.

As illustrated in FIGS. 10A–10B, an edge wheel assembly 150 is mounted adjacent the right side edge of the sewing path. The edge wheel assembly 150 includes an edge guide wheel 151 rotatably mounted to an upstanding wheel support 152 and oriented at a slight angle. The edge wheel assembly further includes a support base 153 mounted adjacent the right side edge of the sewing path, aligned with the guide support assembly 51. A pivoting support arm 154 is pivotally mounted to the support base by a pivot pin 156. The pivoting support arm supports and moves the edge guide wheel 151 between a lowered position engaging the garment between the edge guide wheel and the support base portion 52 of the guide support assembly 51, as illustrated in FIG. 10B, and a raised position shown in FIG. 10A. A pneumatic cylinder 158 (FIGS. 10A and 10B) is mounted to the base 153 and includes an extensible piston rod 159 connected to the support arm 154 for controlling the pivoting movement of the support arm. The piston rod 159 of cylinder 158 is extended upon actuation of the cylinder by the detection of the stitch count by the stitch counter and seam detector as the first sewn portion of the garment approaches the sewing machine at the completion of a sewing cycle. The extension of piston rod 159 causes the edge guide wheel to pivot into its lowered engaging the first sewn portion of the waist of the garment. The edge wheel assembly maintains the first sewn portion of the garment in a desired alignment along the sewing path until completion of the sewing and the removal of the garment.

OPERATION

FIG. 11 provides a schematic illustration of the operation of the elastic waistband attachment system and the timing of the various steps of operation.

At the start of the sewing operation of the elastic waistband attachment system 30 (FIG. 3), the needles 13 and presser foot 36 of the sewing machine 31 are in their raised, nonengaging position above the sewing path 12. The idler wheel 96 of the edge guide assembly 86 (FIG. 4) is in its nonengaging position out of proximity with the drive wheels 87 and 88. The looped elastic waistband 14 (FIG. 1) is loaded into the sewing path 12 of the elastic waistband attachment system, received upon and supported by the retractable guide finger 54 (FIGS. 3 and 4) of the guide support assembly 51 and being received within the concave surface 102 of the waistband guide 101 of the edge guide assembly 86. The waistband is positioned beneath the needles and presser foot of the sewing machine 31 and is stretched about the expansion rollers 74 and 76 of the expansion roller assembly 62.

As illustrated in FIGS. 4 and 6, the loading of the waistband 14 into the sewing path 12 is detected by a band sensor 59 positioned adjacent the guide support assembly 51. In response, the expansion roller assembly 62 (FIGS. 3 and 7) is actuated, causing the roller frame 71 to be moved downwardly in the direction of Arrow A to a first operative position (FIGS. 7 and 8A) by the actuation of cylinder 78 to tension and remove slack from the waistband. Once the elastic waistband 14 (FIGS. 1 and 2) has been loaded on the elastic waistband attachment system, the operator loads the waist portion 19 of the pants 16 onto the elastic waistband attachment system with the waist of the pants being positioned in an overlapping relationship over the waistband 14 as indicated in FIGS. 1 and 2. The waist portion of the pants is received in the sewing path 12, extending beneath the needles and through the garment puller 30 (FIGS. 3 and 5), and about the expansion rollers 74 and 76 (FIG. 3) of the expansion roller assembly 62 and over the drive wheels 87 and 88 (FIG. 4) of the edge guide assembly 86. As the pants are loaded onto the elastic waistband attachment system, the waist of the pants covers a strip of reflecting tape applied to a guide tongue 103. The covering of the reflective tape is detected by a body detector 111 (FIGS. 4 and 6), in response to which the idler wheel 96 of the edge guide assembly 86 is pivoted into its operative position with the waist portion of the pants engaged between the teeth 97 of idler wheel 96 and teeth 91 of drive wheel 87. Also the puller wheel 38 of garment puller 37 is lowered to hold the pants in place. Additionally, cylinder 78 (FIG. 7) of the expansion roller assembly 62 is again actuated to cause the roller frame 71 to move further downwardly in the direction of Arrow A to a second operative position, further stretching and tensioning the waistband and the waist portion of the pants. At this point, with the pants loaded over the waistband, the operator actuates the elastic waistband attachment system 30 (FIG. 3) by engaging the swipe switch 146 to start the sewing operation.

At the start of the sewing operation, the elastic waistband attachment system runs through an initial jog or prefeeding cycle in which the pants and waistband are moved about the sewing path approximately half their circumference to adjust and align the positions of the pants waist and the waistband prior to sewing. The pants and waistband are engaged and pulled along the sewing path by the garment puller 37, which is operated independently of the sewing machine during the prefeeding cycle by jog motor 43. During the prefeeding cycle, the waist edge 21 (FIGS. 1 and 2) of the pants 16 is moved across the sewing path 12 toward the left side thereof by approximately ⅜" so that the waist edge of the pants does not engage or become caught by the cutter (not shown) of the sewing machine.

The position of the waist edge 21 of the pants is controlled by a prefeed guide sensor 112. The prefeed guide sensor generally is directed at a position approximately ⅜" inwardly from the right side of the sewing path, although this position can be adjusted to adjust the amount of fold or overlapping the waist of the pants over the waistband during the prefeeding cycle as desired, and detects the position of the cut waist edge of the pants in the sewing path. During the prefeeding cycle, the prefeed guide sensor senses the position of the waist edge of the pants within the sewing path and causes the drive wheels 87, 88 (FIG. 2) of the edge guide assembly to be reciprocated to urge the waist portion of the pants back and forth across the sewing path to maintain the waist edge of the pants in a desired position spaced inwardly from the right side of the sewing path.

The length of the prefeeding cycle is controlled by movement of the crotch seam 23 over a seam sensor 130 positioned upstream from the folding assembly 61. The crotch seam of the pants drops into a slot 133 formed in the cover 131 of the seam sensor 130 whereupon the crotch seam is detected by the sensor mounted therein as the crotch seam moves over the seam sensor. Once the crotch seam has been detected, a timer is engaged which continues the prefeeding cycle or initial jog of the waist portion of the pants and waistband about the sewing path for a preset time. Thereafter, the prefeeding cycle is stopped with the crotch seam of the pants positioned immediately in front of the sewing needles 13 and the sewing operation is started.

At the start of the sewing operation, control of the edge guide assembly 86 is transferred from the prefeed guide sensor 112 to a body edge sensor 113 positioned adjacent prefeed guide sensor 112 and directed at the rightmost side of the sewing path, at a point approximately ⅜" outwardly from the point of detection of the prefeed guide sensor 112. The body edge sensor detects the position of the waist edge 21 of the pants 16 along the rightmost side edge of the sewing path 12 and reciprocates the drive wheels 87 and 88 of the edge guide assembly 86 to urge or pull the waist edge 21 of the pants across the sewing path to maintain the waist edge 21 of the pants in a desired position along the rightmost side edge of the sewing path. This ensures that the waist edge of the pants will be folded over the waistband sufficient to completely cover and encapsulate the waistband.

The needles 13 and presser foot 36 are lowered into engagement with the pants and control of the garment puller 37 (FIGS. 3 and 5) is transferred from the jog motor 43 of drive means 42 to the sewing machine so that the puller wheel of the garment puller is rotated by the operation of the sewing machine during the sewing operation. The two leftmost needles 13' (FIG. 2) form a bottom cover stitch about the cut waist edge 21 of the pants 16 as excess material is trimmed from the waist edge by the cutter (not shown) of the sewing machine. The three rightmost needles 13 of the sewing machine engage and form a conventional chain stitch through the waist portion of the pants and the waistband to secure the waistband within the folded portion 22 of the waist of the pants.

As illustrated in FIGS. 1 and 2, as the waist portion of the pants and waistband are pulled along the sewing path toward the sewing area 33, the waist portion 19 of the pants 16 is engaged between the front edge 68 of the folder tongue 67 and the stationary folder plate 63, causing the waist edge of the pants to be urged downwardly and across the waistband, forming a folded portion 22 in the waist 19 of the pants 16. The folding of the waist edge of the pants over the waistband further is aided by air nozzle 136 (FIG. 4), which directs a flow of air upwardly against the waist edge of the pants. Thereafter, as indicated in FIG. 2, the folded portion pants and the waistband, pass beneath and are engaged by the sewing needles 13.

As the waist of the pants and waistband are sewn, the elastic waistband attachment system counts the stitches being formed in the garment between the start of the sewing operation and the detection of a first portion of the crotch seam 23 of the pants by the seam sensor 130, which indicates that the pants have completed approximately a one-half revolution. The number of stitches indicates the size of the garment being sewn and further is used to control the completion of guiding of the waist edge of the garment by the edge guide assembly and the activation of edge wheel assembly 150 as the first sewn part of the garment approaches the sewing area.

As the stitch count again is reached during the second phase of the sewing cycle, the idler wheel 96 of the edge guide assembly 86 is retracted. At the same time, the retractable guide finger 54 of the guide support assembly 51 and the folder tongue 67 of folding assembly 61 are retracted out of the sewing path as the sewn portion of the garment approaches the sewing area. A lift roller 141, (FIG. 4) also is pivoted upwardly into an engaging position, lifting the garment upwardly above the sewing path.

As the first sewn portion of the garment approaches the sewing area, the first sewn portion generally is positioned inwardly of the right side of the sewing path, such that it generally is not detected by the body edge sensor controlling the edge guide assembly. Accordingly, as the idler wheel of the edge guide assembly is retracted, an edge wheel assembly 150 (FIGS. 4 and 10B) is actuated. The edge wheel assembly moves an edge guide wheel 151 downwardly, as illustrated in FIG. 10B, into engagement with the body of the garment. The garment is engaged between the edge guide wheel and the support base of the guide support assembly such that the garment is prevented from shifting or moving laterally across the sewing path, but is permitted to continue its forward movement along the sewing path toward the needles of the sewing machine. As a result, the sewing cycle can be completed with the remaining portion of the waist edge of the garment being folded over and sewn about the waistband.

Thereafter, as a second portion of the crotch seam 23 (FIG. 2) is detected by seam sensor 130, the elastic waistband attachment systems senses the completion of the sewing cycle and continues to run for a preset time to complete the trimming and sewing of the waist edge of the pants about the waistband. The system then stops sewing and trimming and severs the threads of the sewing needles as the pants are removed from the elastic waistband attachment system.

Additionally, as shown in FIGS. 8A–8C, the expansion roller assembly 62 is capable of being pivoted or tilted in the direction of arrows or during a sewing operation in response to the position of the crotch seam 23 of the pants 16 along the sewing path. The crotch seam of the pants tends to restrict the stretching of the pants such that the pants of a significant degree of stretch in a direction perpendicular to the length of the crotch seam, but the amount of stretch of the pants is significantly limited in the direction of the length of the crotch seam. As a result, as the pants are revolved along the sewing path under tension, the position of the crotch seam path tends to cause the waist of the pants to move about the expansion rollers in an elliptical motion. In response, the roller frame 71 tilts as illustrated in FIGS. 8B and 8C in the direction of the crotch seam of the pants to relieve any excess tension therefrom.

If the tension in the pants due to the position of the crotch seam along a sewing path is increased significantly such that the tilting of the roller frame cannot equalize such tension, such increased tension will tend to cause the waist portion of the pants to engage and cause a tension roller 82 to be lifted upwardly slightly. In response, as indicated in FIG. 8A, the roller frame 71 is raised in the direction of arrow A' a distance sufficient to alleviate the excess tension being placed upon the pants. Thereafter, as the tension in the pants lessens and the tension roller is released, the roller frame moves downwardly in the direction of arrow A to maintain substantially equal tension on the waist portion of the pants during the sewing operation.

The present invention thus provides for the automatic attachment of a looped elastic waistband to the body of a garment which enable an operator to operate two machines substantially simultaneously, significantly increasing the production rate of the operator for producing garments having and elastic looped waistband encapsulated and sewn about the waist of the garment. It should be understood that while the present elastic waistband attachment system has been disclosed in relation to attaching an elastic waistband to a pair of pants, the present invention also can be used for attaching an elastic loop waistband to other garments such as sweat shirts, etc.

It further will be understood that the foregoing relates only to a preferred embodiment of the present invention, and it is anticipated that numerous changes and modifications may be made thereto without departing from the spirit and scope of the invention as set forth in the following claims.

We claim:

1. A method of attaching a looped elastic band to the waist edge portion of a garment, comprising the steps of:

(a) supporting the elastic band in a stretched loop configuration;

(b) placing the waist edge of the garment in surrounding overlapping relationship with respect to the band;

(c) stretching the overlaid portions of the band and waist edge portion of the garment to expand the overlaid portions of the band and waist edge portion of the garments to a common breadth;

(d) advancing the garment and band in a prefeeding cycle along a sewing path through a sewing area, with edges of the band and garment passing adjacent a cutter of the sewing station;

(e) detecting the position of the waist edge of the garment along the sewing path as the garment and band are moved during the prefeeding cycle;

(f) in response to the detection moving the waist edge of the garment across the band to align the pants and band and maintain the waist edge of the pants out of engagement with the cutter prior to the start of a sewing operation;

(g) advancing the band and waist edge portion of the garment along their lengths along the sewing path through a sewing area in a sewing cycle and forming stitches in the overlaid portions of the band and garment to connect the band and garment together;

(h) as the band and garment are advanced toward the sewing station during a sewing operation, folding an edge of the garment about the band so that the band is enclosed within the fold of the garment as the folded edge of the garment is sewn; and (i) moving the garment in a reciprocating motion across the sewing path to position the waist edge of the garment to a desired position for folding.

2. The method of claim 1 and further comprising the steps of detecting a seam portion of the garment during the prefeeding cycle, and, after detecting the first seam portion, stopping the prefeeding cycle after a predetermined time to position the first seam of the garment at a desired position before starting a sewing cycle.

3. The method of claim 1 and wherein the step of detecting the position of the waist edge of the garment comprises detecting a seam of the garment that extends normal to the waist edge of the garment, and further comprising the step of counting the stitches formed in the garment and band as the band and garment are sewn together, between the detection of the first seam of the garment and a second seam of the garment as the seams approach the sewing station for controlling a sewing operation.

4. The method of claim 2 and further comprising the steps of detecting the first seam of the garment approaching the sewing station at the completion of a sewing cycle, after the first seam of the garment is detected, continuing to form stitches in the band and garment for a preset time, and terminating the sewing cycle upon reaching the preset time.

5. The method of claim 1 and wherein the step of stretching the overlaid portions of the band and garment comprises the step of detecting the presence of the garment overlaid over the band, and in response, moving an expansion roller assembly perpendicular to the sewing path to stretch the band and garment.

6. The method of claim 5 and further including pivoting the expansion roller assembly in response to increased tightness of the garment to relieve excess tension on the garment.

7. The method of claim 5 and further including the steps of engaging a tension roller mounted to the expansion roller assembly as the garment is stretched and tension in the garment is increased during a sewing operation, and raising the expansion roller assembly in response to the engagement of the tension roller to relieve excess tension from the garment.

8. The method of claim 1 and further including the steps of detecting a sewn portion of the garment indicative of the completion of the sewing cycle, and engaging the garment with an edge wheel assembly to maintain the waist edge of the garment along the sewing path for folding and sewing of the waist edge about the band as the sewing cycle is completed.

9. A system for attaching a looped waistband to the waist edge of a pair of pants, comprising:

a sewing machine positioned along a sewing path for forming stitches for connecting the waistband to a waist edge of the pants during a sewing cycle;

means for holding and stretching the waistband and waist edge of the pants as the waistband and pants are moved along the sewing path;

drive means for advancing the waistband and pants along the sewing path;

means for folding the waist edge of the pants about the waistband prior to engagement of the waistband and pants by said sewing machine so that the waistband is enclosed within the folded waist edge of the pants;

edge guide means for maintaining the waist edge of the pants in position along the sewing path in alignment with said means for folding, said edge guide means being positioned upstream from said means for folding and adapted to engage and move the pants in a reciprocating motion across the sewing path in response to the detection of the waist edge of the pants in and out of the sewing path; and sensor means including a body sensor positioned above the sewing path for detecting the movement of the waist edge of the pants into the sewing path and controlling said edge guide means to align the waist edge along the sewing path, and a body edge sensor for detecting the presence and absence of an unfolded portion of the waist edge of the pants.

10. A system for attaching a looped waistband to the waist edge of a pair of pants, comprising:

a sewing machine positioned along a sewing path for forming stitches for connecting the waistband to a waist edge of the pants during a sewing cycle;

means for holding and stretching the waistband and waist edge of the pants as the waistband and pants are moved along the sewing path;

drive means for advancing the waistband and pants along the sewing path, means for folding the waist edge of the pants about the waistband prior to engagement of the waistband and pants by said sewing machine so that the waistband is enclosed within the folded waist edge of the pants;

edge guide means for maintaining the waist edge of the pants in position along the sewing path in alignment with said means for folding, said edge guide means being positioned upstream from said means for folding and adapted to engage and move the pants across the sewing path; and means for detecting a crotch seam of the pants, said detecting means comprising a seam detector positioned along the sewing path upstream from said sewing machine in a position to be engaged by the crotch seam as the waistband and waist edge of the pants are moved along the sewing path.

11. The system of claim 10 and further including means for counting the stitches formed in the waist edge of the pants and in the waistband between the detection of a first portion of the seam of the pants and the detection of a second portion of the seam by said seam detector for controlling the sewing operation.

12. a system for attaching a looped waistband to the waist edge of a pair of pants comprising:

a sewing machine positioned along a sewing path for forming stitches for connecting the waistband to a waist edge of the pants during a sewing cycle;

an expansion roller assembly having a pivotable roller frame, expansion rollers mounted at opposite ends of said roller frame and about which the waistband and waist edge of the pants are received, and means for moving said roller frame vertically to stretch the waistband and pants drive means for advancing the waistband and pants along the sewing path;

means for folding the waist edge of the pants about the waistband prior to engagement of the waistband and pants by said sewing machine so that the waistband is enclosed within the folded waist edge of the pants; and edge guide means for maintaining the waist edge of the pants in position alone the sewing path in alignment with said means for folding, said edge guide means being positioned upstream from said means for folding and adapted to engage and move the pants in a reciprocating motion across the sewing path in response to the detection of the waist edge of the pants in and out of the sewing path.

13. The system of claim 12 and further including a tension roller mounted to said frame between said expansion rollers, whereby as tension on the band and pants increases during the movement of the waistband and waist edge of the pants about the sewing path, said tension roller is engaged and causes said expansion roller assembly to be raised to relieve excess tension from the waistband and pants.

14. The system of claim 9 and further including a band sensor for detecting the presence of the waistband in the sewing path.

15. The system of claim 9 and further including a prefeed guide sensor positioned above the sewing path adjacent said body sensor for detecting the position of the waist edge of the pants in the sewing path and controlling said edge guide means during prefeeding of the pants and waistband to maintain the waist edge of the pants in an alignment spaced slightly inwardly from the sewing path such that the waist edge of the pants passes adjacent and out of engagement with a cutter of the sewing machine prior to the start of a sewing operation.

16. The system of claim 9 and further including an edge wheel assembly positioned adjacent the sewing path downstream from said edge guide means and including an edge guide wheel movable into engagement with the garment whereby as a first sewn portion of the garment approaches said sewing machine, said edge guide means is disengaged from the garment and said edge guide wheel is moved into engagement with the garment to maintain the garment within the sewing path as the sewing cycle of the garment is completed.

17. A method of attaching a looped elastic waistband within a folded portion about the continuous waist edge portion of a pair of pants, comprising the steps of:

placing an edge portion of the pants in surrounding, overlying relationship about the waistband, with the waist edge portion of the pants overlapping the waistband;

expanding the waistband and the waist edge portion of the pants until they are of substantially the same breadth and under tension;

advancing the waistband and waist edge portion of the pants along their lengths in a sewing path toward a sewing station while under tension;

as the waistband and waist edge portion of the pants are advanced along the sewing path, folding and sewing the waist edge portion of the pants about the waistband during a sewing cycle; and detecting a first seam portion of the pants approaching the sewing station with a seam sensor and in response, continuing to advance and sew the waistband and waist edge portion of the pants for a desired time, and terminating the advancing and sewing of the waistband and the waist edge portion of the pants.

18. The method of claim 17 and further including the steps of detecting of the waistband and waist edge portion of the pants within the sewing path, and in response, moving an expansion roller assembly against the looped waistband and waist edge portion to stretch the waistband and the waist edge portion of the pants to a common breadth.

19. The method of claim 18 and further including the steps of moving with the waistband a tension roller mounted to the expansion roller assembly as the waistband and waist edge portion of the garment are stretched and moving the expansion roller assembly toward or away from the waistband in response to the movement of the tension roller to adjust the tension in the garment.

20. The method of claim 18 and further including pivoting the expansion roller assembly in response to increased tightness of the garment to relieve excess tension on the garment.

21. The method of claim 17 and further including the steps of moving the waist edge portion of the pants and the waistband through a prefeeding cycle with the waist edge portion of the pants passing adjacent a cutter of the sewing station, and moving the waist edge portion of the pants across the sewing path in a reciprocating motion to align the pants and waistband and maintain the waist edge portion of the pants out of engagement.

22. The method of claim 18 and further including the steps of detecting the position of the waist edge portion of the pants within the sewing path and, in response, reciprocating the waist edge portion of the pants across the sewing path to ensure the waist edge portion will be folded over the waistband sufficiently to encapsulate the waistband.

23. The method of claim 17 and further comprising the steps of counting stitches formed between the actuation of the sewing cycle and a second seam portion of the pants being detected to generate a stitch count, continuing to sew the waistband and waist edge portion of the pants and count stitches formed between the second and first seam portions of the pants, and as the stitch count previously generated is reached, engaging the pants with an edge guide wheel to maintain the pants and waistband in the sewing path as the sewing cycle is completed.

24. A system for attaching a looped elastic waistband within a folded portion of the waist portion of a garment, comprising:

a sewing station positioned along a sewing path for the waistband and garment;

a folding assembly positioned upstream from said sewing station along the sewing path in a position to be engaged by the waist portion of the garment and cause the waist portion to be folded over the waistband;

means for holding and stretching the waistband and waist portion of the pants as the waistband and waist portion of the pants are moved along the sewing path;

edge guide means for maintaining the waist edge of the pants in position along the sewing path in alignment with said means for folding, positioned upstream from said means for folding and adapted to engage and move the pants in a reciprocating motion across the sewing path in response to the detection of the waist edge of the pants in and out of the sewing path; and a seam detector positioned along the sewing path upstream from said sewing station in a position to be engaged by a seam of the garment for controlling a sewing operation.

25. The system of claim 24 and further including an edge wheel assembly positioned adjacent the sewing path downstream from said edge guide means and including an edge guide wheel movable into engagement with the garment whereby as a first sewn portion of the garment approaches said sewing machine, said edge guide means is disengaged from the garment and said edge guide wheel is moved into engagement with the garment to maintain the garment within the sewing path as the sewing operation of the garment is completed.

26. The system of claim 24 and wherein said means for holding and stretching the waistband and pants comprises an expansion roller assembly having a pivotable roller frame, expansion rollers mounted at opposite ends of said roller frame and about which the waistband and waist edge of the pants are received, and means for moving said roller frame vertically to stretch the waistband and pants.

27. The system of claim 26 and further including a tension roller mounted to said frame between said expansion rollers, whereby as tension on the band and pants increases during the movement of the waistband and waist edge of the pants about the sewing path, said tension roller is engaged and causes said expansion roller assembly to be raised to relieve excess tension from the waistband and pants.

28. The system of claim 24 and wherein said sensor means includes a band sensor positioned below the sewing path for detecting the presence of the waistband in the sewing path, a body sensor positioned above the sewing path for detecting the movement of the waist edge of the pants into the sewing path and controlling said edge guide means to align the waist edge along the sewing path, and a body edge sensor for detecting the presence and absence of an unfolded portion of the waist edge of the pants for terminating the sewing operation.

29. The system of claim 28 and further including a prefeed guide sensor positioned above the sewing path adjacent said body sensor for detecting the position of the waist edge of the pants in the sewing path and controlling said edge guide means during prefeeding of the pants and waistband to maintain the waist edge of the pants in an alignment spaced slightly inwardly from the sewing path such that the waist edge of the pants passes adjacent and out of engagement with a cutter of the sewing machine prior to the start of a sewing operation.

30. A process of sewing a continuous loop waistband to a continuous loop waist edge portion of a garment part that is more stretchable in one diametrical direction across the waist edge portion and less stretchable in another diametrical direction, comprising:

matching the waist edge of the garment part with the waistband;

expanding the matched waist edge of the garment part and the waistband until they are of substantially the same breadth in a closed loop;

advancing the matched waist edge and waistband along their lengths in a closed loop path through a sewing machine and through a return path;

sewing together the waist edge to the waistband as they are advanced through the sewing machine; and as the waist edge is advanced along the return path, expanding the portion of the loop of waistband and waist edge in the return path in the more stretchable direction and collapsing the waistband and waist edge in the less stretchable direction.

31. A process of sewing a continuous loop waistband to a continuous loop waist edge portion of a garment part, comprising:

matching the waistband with the waist edge portion of the garment part;

expanding the matched waistband and waist edge of the garment part until they are of substantially the same breadth in a closed loop;

advancing the matched waistband and waist edge along their lengths in a closed loop path through a sewing machine and through a return path;

sewing together the waistband and waist edge as they are advanced through the sewing machine;

as the matched waistband and waist edge are advanced toward the sewing machine, moving the waist edge in contact with spaced guide wheels and a rotary sheave positioned between the guide wheels to separate the waistband from the waist edge; and while the waistband and waist edge are separated from each other rotating the guide wheels to shift the waistband and waist edge laterally with respect to each other to align the waistband and waist edge with respect to each other for movement toward the sewing machine.

32. An alignment system for separating and aligning a waistband and a waist edge of a garment which are matched with each other and are under tension and as they are advanced along their lengths toward a sewing machine, comprising:

a rotary sheave having a concave waistband support surface for receiving and guiding the waistband toward the sewing machine;

a pair of rotary guide wheels positioned on opposite sides of said sheave;

each of said rotary guide wheels being substantially spherical and including externally radiating teeth for engaging the waist edge, said teeth being oriented in the direction of movement of the waist edge when engaged by the waist edge;

said rotary guide wheels being of larger diameter than the diameter of said concave waistband support surface separating the waist edge from the waistband; and means for rotating said rotary guide wheels and shifting the waist edge laterally with respect to the waistband.

33. The alignment system of claim 32 and further comprising an edge wheel assembly adapted to be movable into engagement with the garment as the alignment system is disengaged from aligning the waist band and waist edge of the garment during a sewing cycle for controlling and maintaining the waistband and waist edge of the garment in alignment as a first sewn portion of the waistband and waist edge of the garment approach the sewing machine as the sewing cycle is completed.

* * * * *